US010092887B2

(12) United States Patent
Pappalardo

(10) Patent No.: US 10,092,887 B2
(45) Date of Patent: Oct. 9, 2018

(54) STATIC MIXERS AND METHODS FOR USING AND MAKING THE SAME

(71) Applicant: NORDSON CORPORATION, Westlake, OH (US)

(72) Inventor: Matthew E. Pappalardo, Ewing, NJ (US)

(73) Assignee: Nordson Corporation, Westlake, OH (US)

( * ) Notice: Subject to any disclaimer, the term of this patent is extended or adjusted under 35 U.S.C. 154(b) by 110 days.

(21) Appl. No.: 15/141,754

(22) Filed: Apr. 28, 2016

(65) Prior Publication Data

US 2016/0325246 A1 Nov. 10, 2016

Related U.S. Application Data

(60) Provisional application No. 62/156,958, filed on May 5, 2015.

(51) Int. Cl.
*B01F 5/06* (2006.01)

(52) U.S. Cl.
CPC ..... *B01F 5/0606* (2013.01); *B01F 5/061* (2013.01); *B01F 5/0615* (2013.01); *B01F 5/0645* (2013.01); *B01F 2005/0636* (2013.01)

(58) Field of Classification Search
USPC ..... 366/337
See application file for complete search history.

(56) References Cited

U.S. PATENT DOCUMENTS

| | | | |
|---|---|---|---|
| 3,647,187 | A | 3/1972 | Dannewitz |
| 8,915,892 | B2 | 12/2014 | Klewinghaus |
| 2014/0050614 | A1 | 2/2014 | Klewinghaus |
| 2014/0261713 | A1 | 9/2014 | Schriver et al. |

FOREIGN PATENT DOCUMENTS

| | | | |
|---|---|---|---|
| WO | 2006038298 | A1 | 4/2006 |
| WO | 2014184585 | A2 | 11/2014 |

OTHER PUBLICATIONS

European Application No. 16168417.0: European Extended Search Report dated Oct. 16, 2014, 9 pages.

*Primary Examiner* — Mark Halpern
(74) *Attorney, Agent, or Firm* — Baker & Hostetler LLP

(57) ABSTRACT

A static mixer for mixing a mass fluid flow includes an elongate body including an open proximal end, an open distal end and an inner wall. At least a portion of the inner wall includes a plurality of undercuts formed therein to define a convoluted conduit. The conduit extends along a central axis between the proximal end and the distal end. A portion of the undercuts defines a center-to-perimeter flow portion within the conduit. A portion of the undercuts defines a perimeter-to-center flow portion within the conduit.

25 Claims, 29 Drawing Sheets

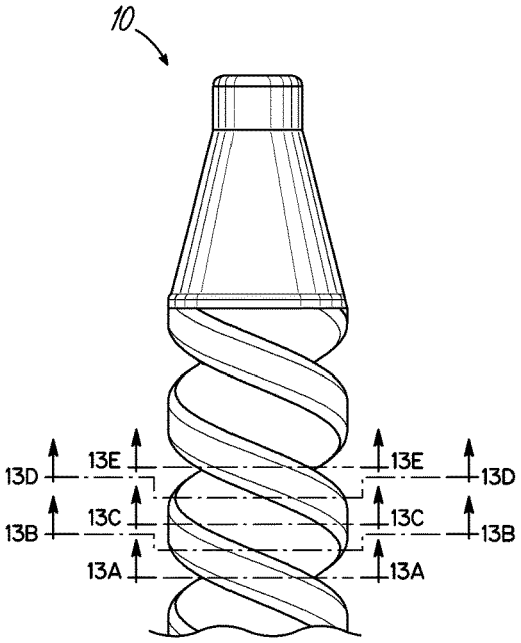
FIG. 12
FIG. 13A
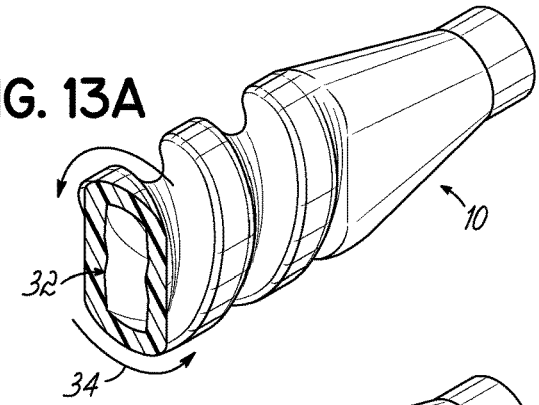
FIG. 13B
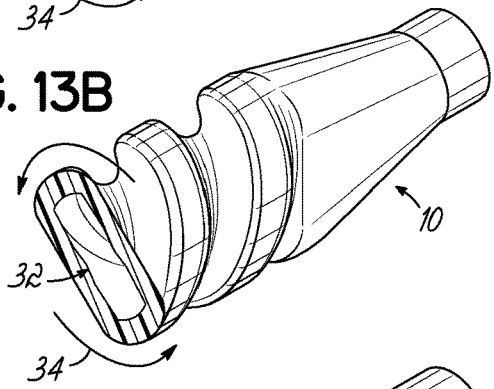
FIG. 13C
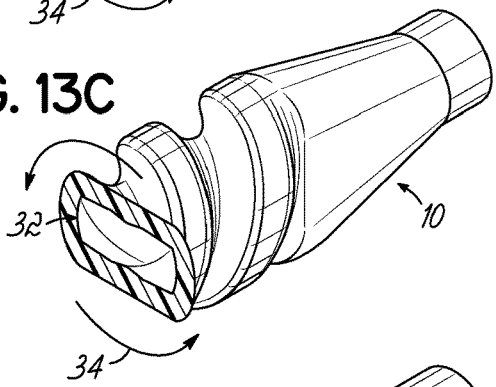
FIG. 13D
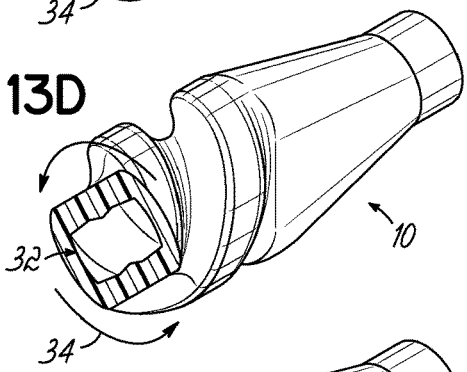
FIG. 13E
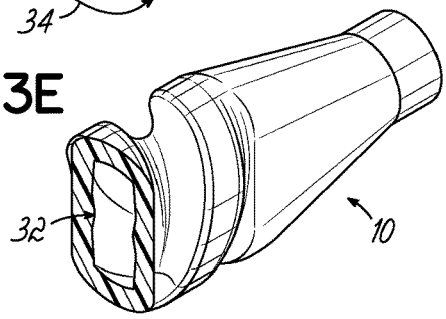

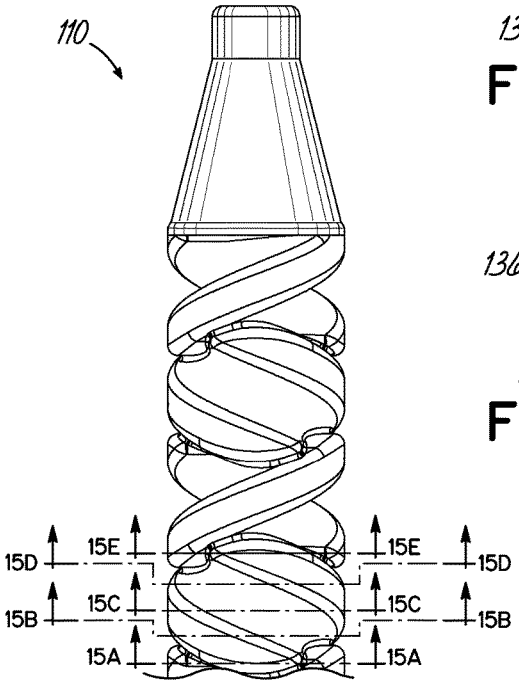
FIG. 14
FIG. 15A
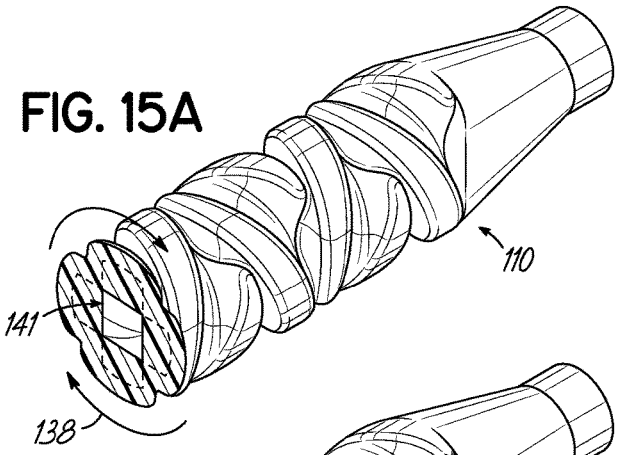
FIG. 15B
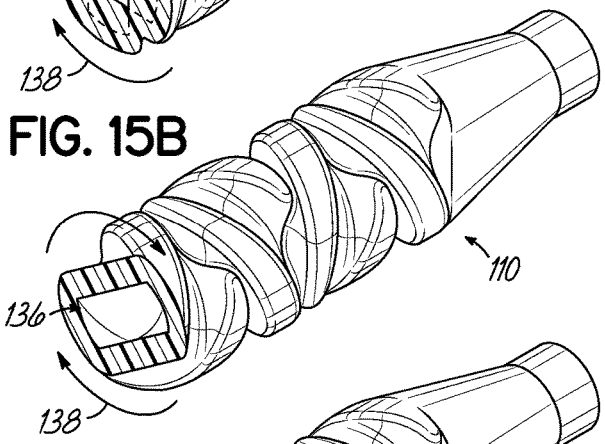
FIG. 15C
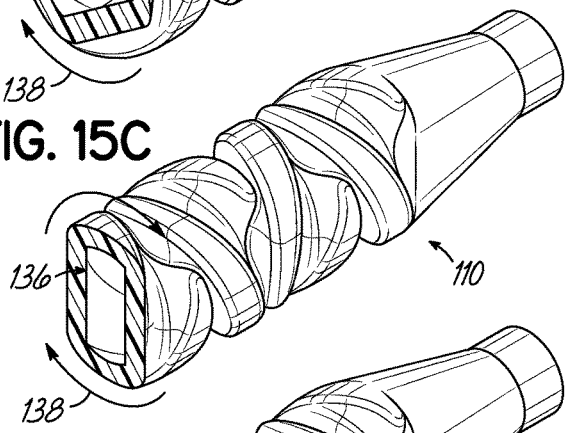
FIG. 15D
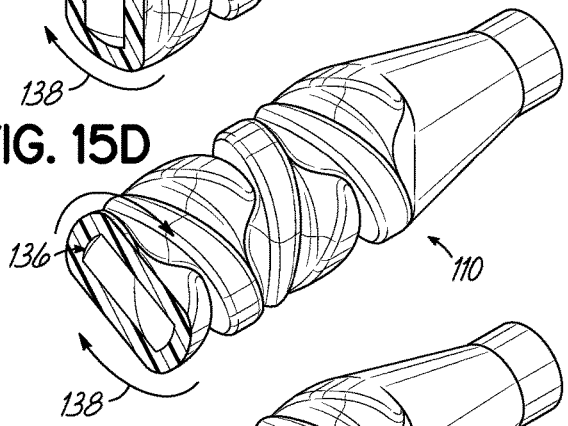
FIG. 15E
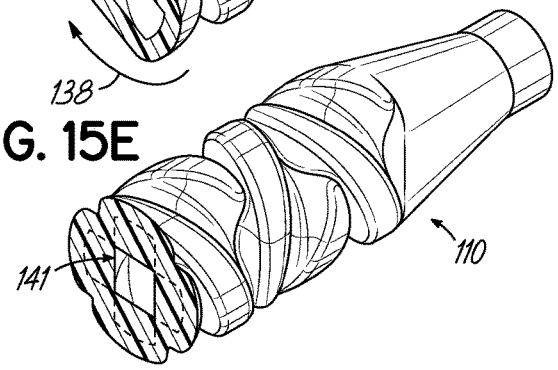

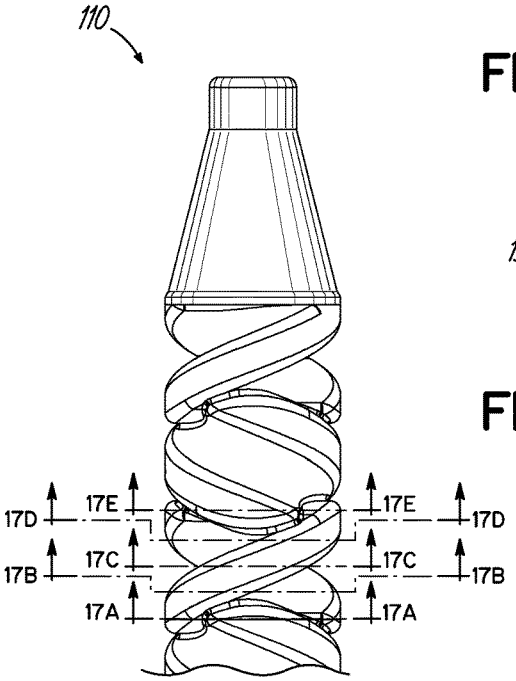
FIG. 16
FIG. 17A
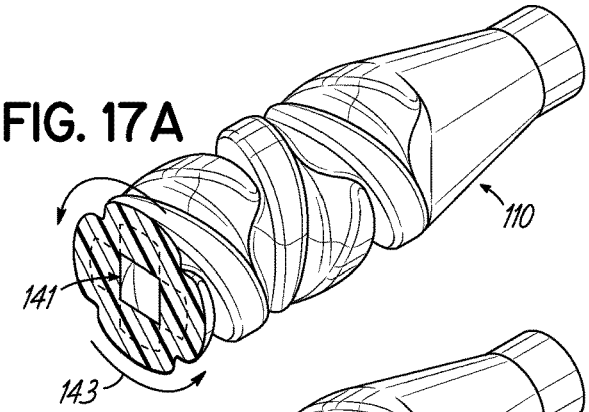
FIG. 17B
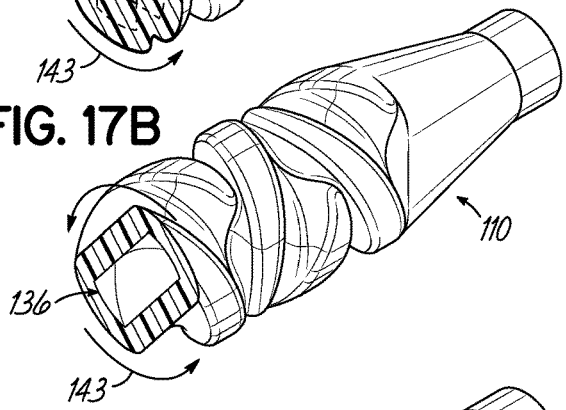
FIG. 17C
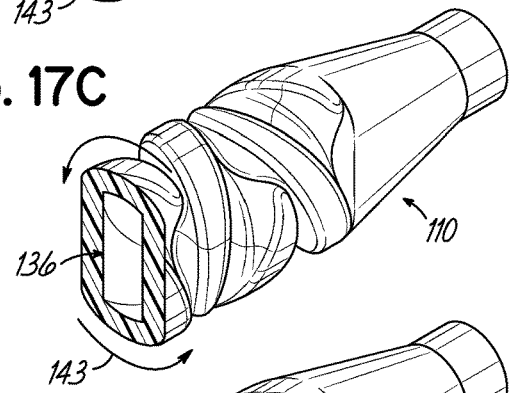
FIG. 17D
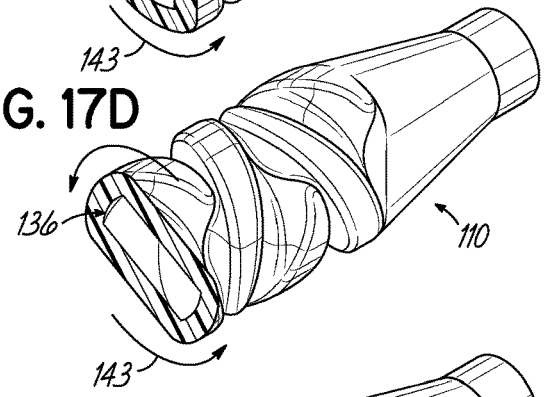
FIG. 17E
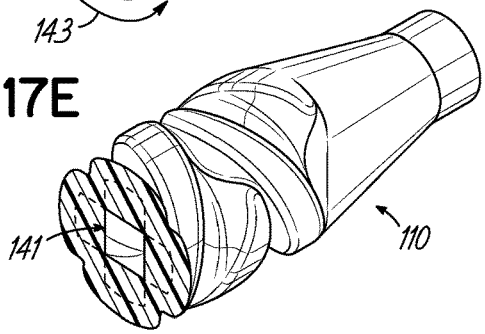

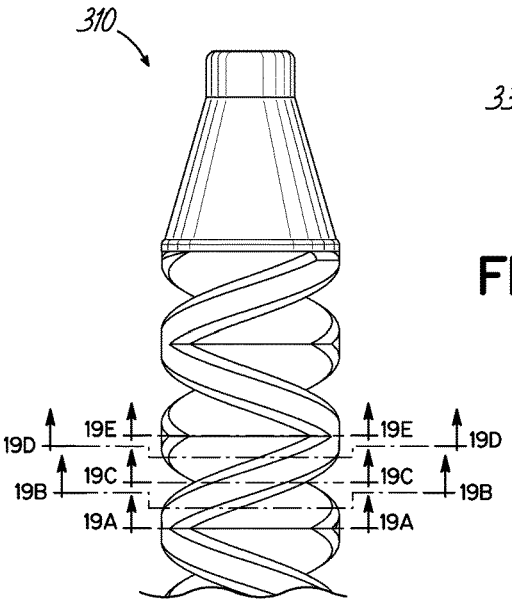
FIG. 18
FIG. 19A
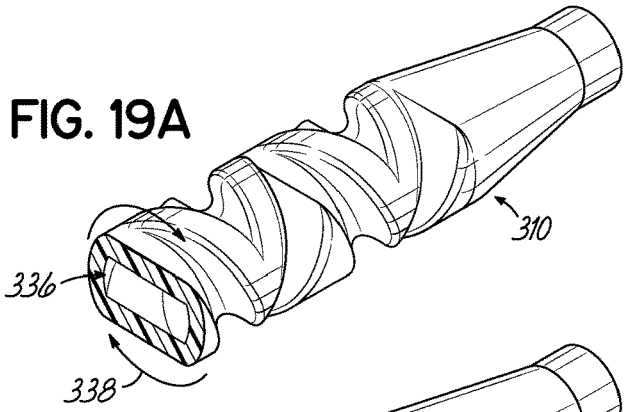
FIG. 19B
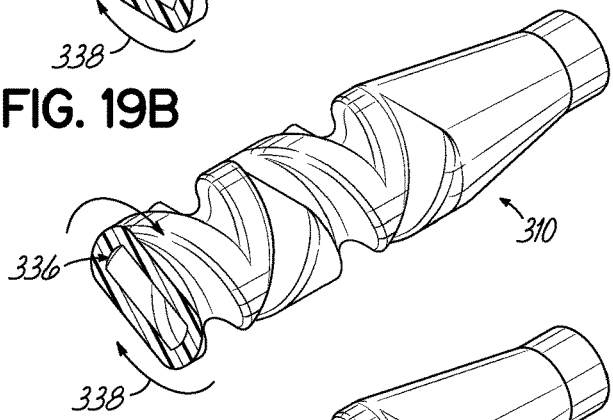
FIG. 19C
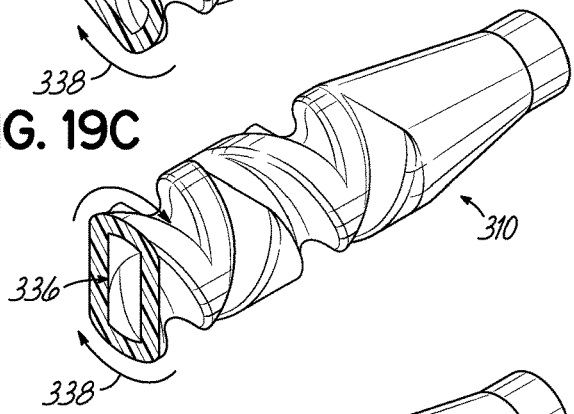
FIG. 19D
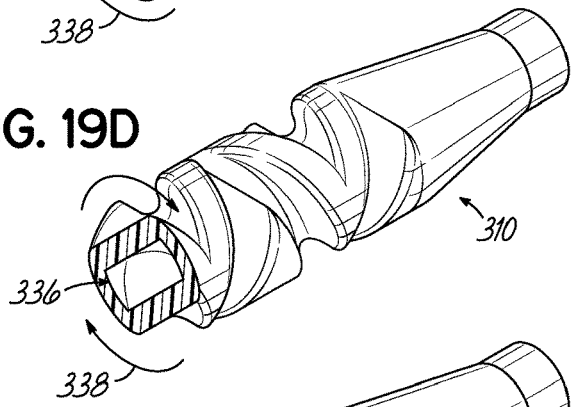
FIG. 19E
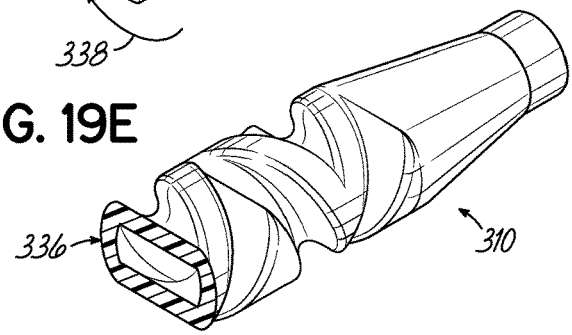

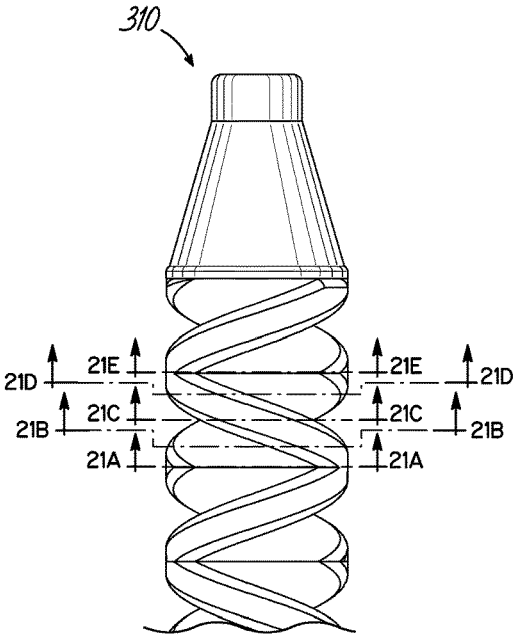
FIG. 20
FIG. 21A
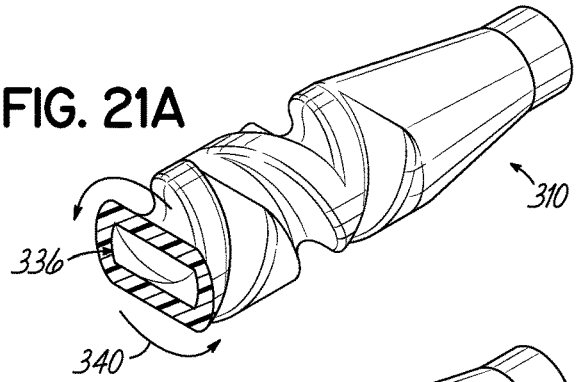
FIG. 21B
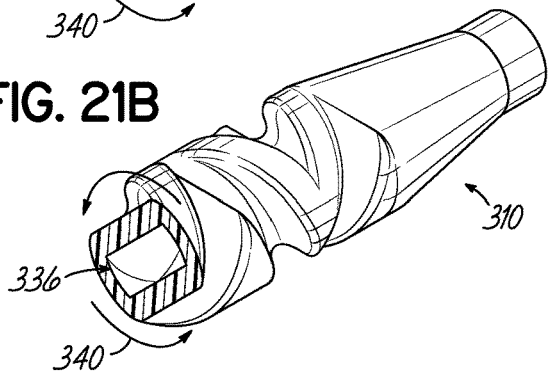
FIG. 21C
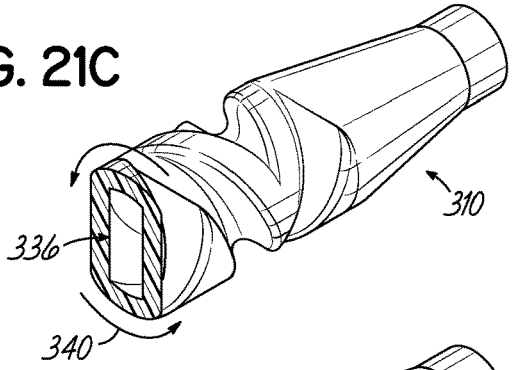
FIG. 21D
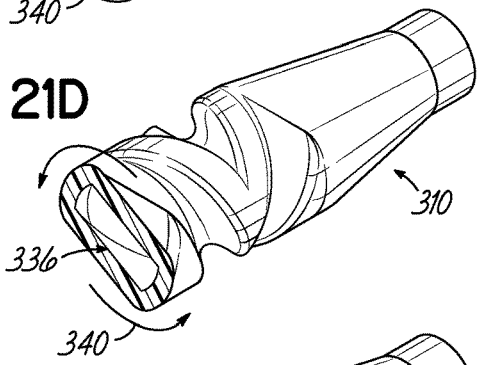
FIG. 21E
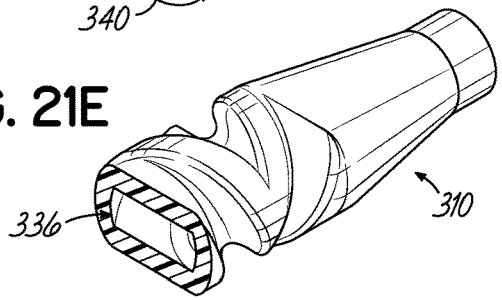

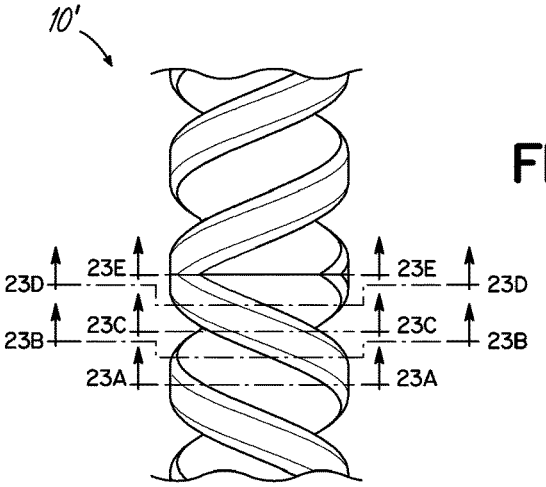
FIG. 22
FIG. 23A
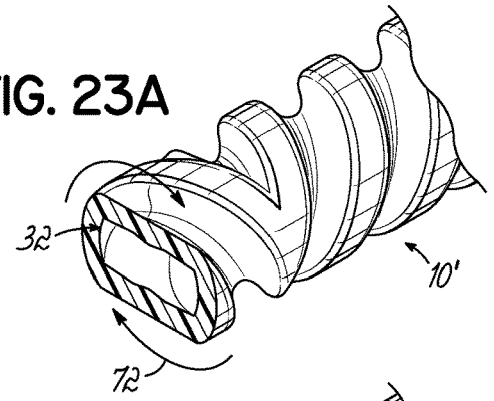
FIG. 23B
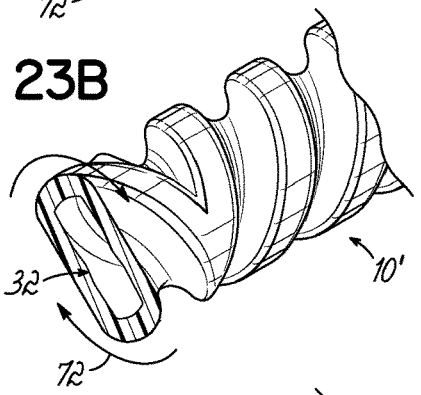
FIG. 23C
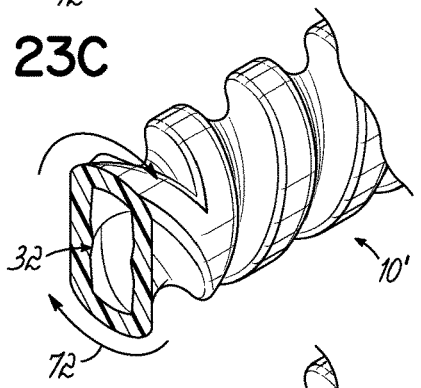
FIG. 23D
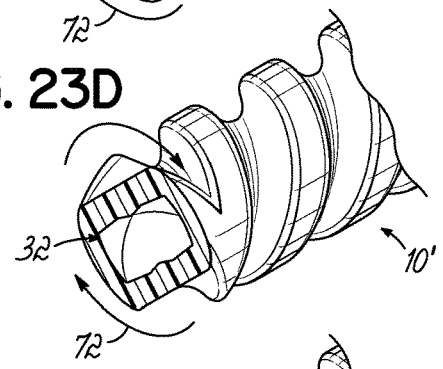
FIG. 23E
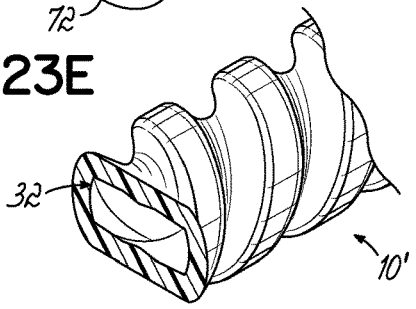

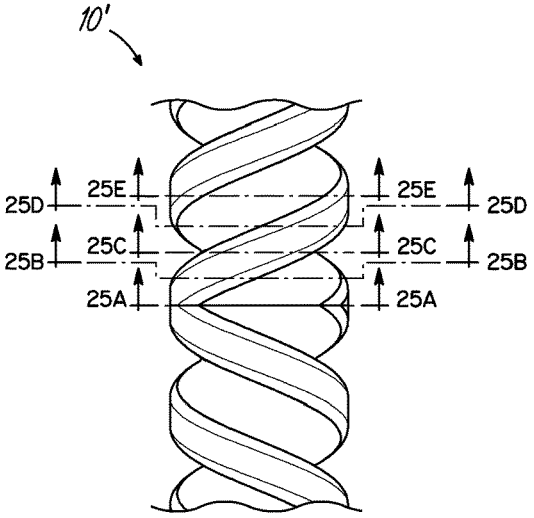
FIG. 24
FIG. 25A
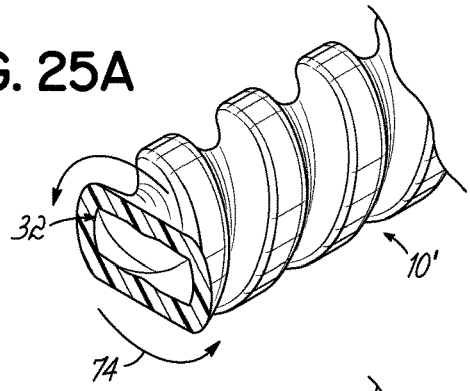
FIG. 25B
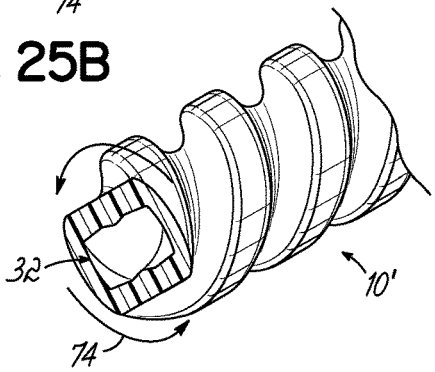
FIG. 25C
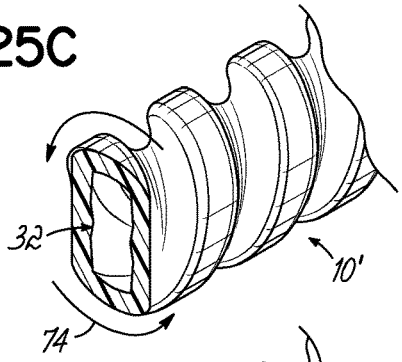
FIG. 25D
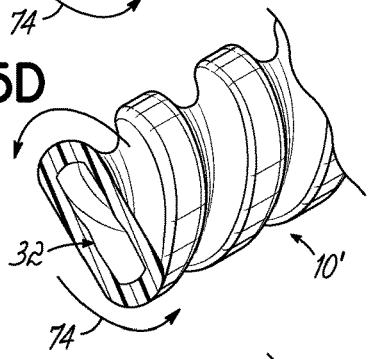
FIG. 25E
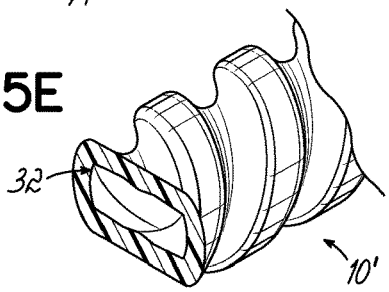

FIG. 27A
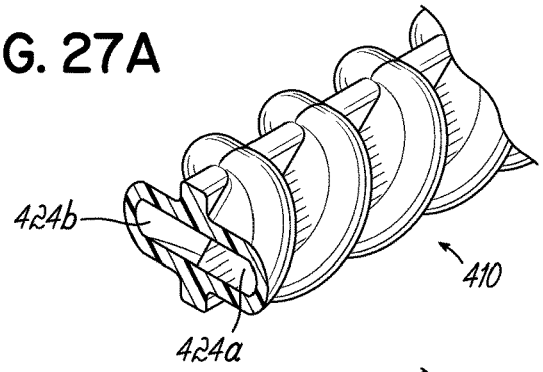
FIG. 27B
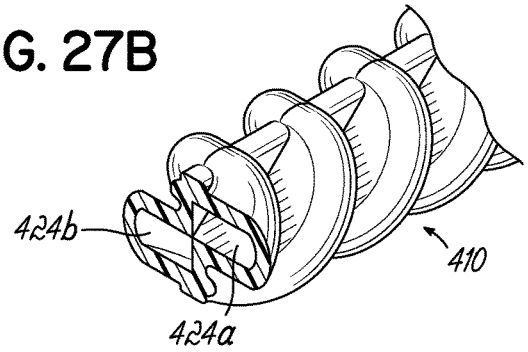
FIG. 27C
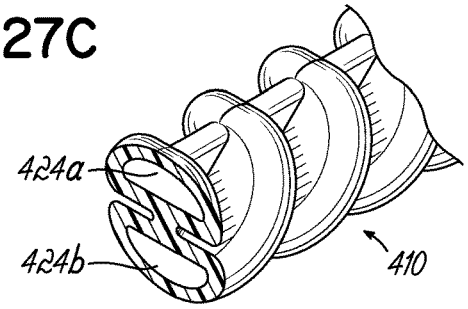
FIG. 27D
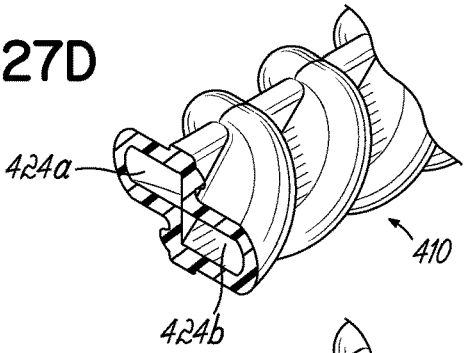
FIG. 27E
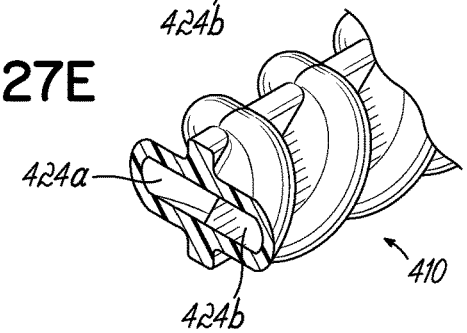
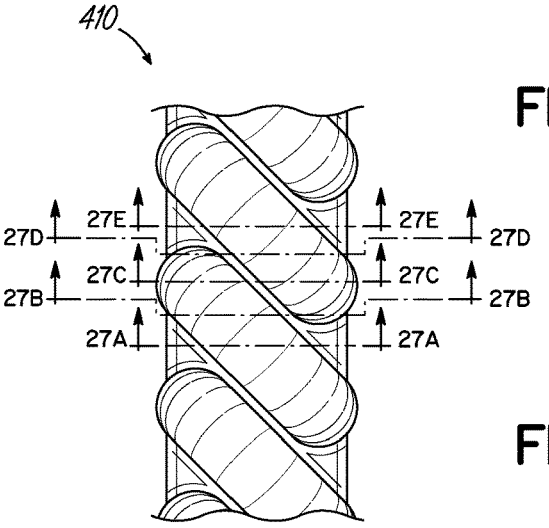
FIG. 26

STATIC MIXERS AND METHODS FOR USING AND MAKING THE SAME

CROSS REFERENCE TO RELATED APPLICATIONS

This application claims priority to provisional U.S. Patent App. No. 62/156,958, filed May 5, 2015, the entire contents of which is incorporated herein by reference.

FIELD OF THE INVENTION

The present disclosure generally relates to the mixing of fluids, and more particularly to mixing fluids using static mixers.

BACKGROUND

A number of motionless or static mixer types exist. These mixer types, for the most part, implement the same general principle to mix materials, such as fluids, together. In these mixers, fluids are mixed together by dividing the fluids into several flow paths, and recombining the fluids until the layers of the fluids are mixed to a point where they are thin and eventually diffuse past one another. This action is achieved by forcing the fluid over a series of mixing baffles of alternating geometry. Such division and recombination causes the layers of the fluids being mixed to thin and eventually diffuse past one another.

Mixers in the current state of the art include at least two parts. The first part is a housing or tube that acts as a fluid conduit through which the materials to be mixed may flow. The second part is a separate mixing element, having a plurality of baffles or other features that are configured to mix the fluids in the manner described above. In order to manufacture such static mixers, the first and second parts are made separately by injection molding. Then, once the individual parts are manufactured, the manufacturer must perform the additional step(s) of inserting the mixing element or multiple mixing elements into the housing and rigidly fixing it thereto (i.e., via adhesives, plastic welding, interference fit, etc.). Despite the success of such static mixers, there are drawbacks to current designs. In order to manufacture a high number of injection molded parts efficiently, a high amount of molds must be used, which may be very costly. Moreover, the injection molding process presents limitations to the geometries of the mixing elements. Despite the success and efficacy of multiple part, injection molded static mixers, there is a need for improvement in the art.

BRIEF DESCRIPTION OF THE DRAWINGS

FIG. 12 is a partial side view of the static mixer of FIG. 1.

FIG. 13A is a perspective cross-sectional view of the static mixer of FIG. 1, taken along line 13A-13A shown in FIG. 12;

FIG. 13B is a perspective cross-sectional view of the static mixer of FIG. 1, taken along line 13B-13B shown in FIG. 12;

FIG. 13C is a perspective cross-sectional view of the static mixer of FIG. 1, taken along line 13C-13C shown in FIG. 12;

FIG. 13D is a perspective cross-sectional view of the static mixer of FIG. 1, taken along line 13D-13D shown in FIG. 12;

FIG. 13E is a perspective cross-sectional view of the static mixer of FIG. 1, taken along line 13E-13E shown in FIG. 12;

FIG. 14 is a partial side view of the static mixer of FIG. 4;

FIG. 15A is a perspective cross-sectional view of the static mixer of FIG. 4, taken along line 15A-15A shown in FIG. 14;

FIG. 15B is a perspective cross-sectional view of the static mixer of FIG. 4, taken along line 15B-15B shown in FIG. 14;

FIG. 15C is a perspective cross-sectional view of the static mixer of FIG. 4, taken along line 15C-15C shown in FIG. 14;

FIG. 15D is a perspective cross-sectional view of the static mixer of FIG. 4, taken along line 15D-15D shown in FIG. 14;

FIG. 15E is a perspective cross-sectional view of the static mixer of FIG. 4, taken along line 15E-15E shown in FIG. 14;

FIG. 16 is a view similar to FIG. 14;

FIG. 17A is a perspective cross-sectional view of the static mixer of FIG. 4, taken along line 17A-17A shown in FIG. 16;

FIG. 17B is a perspective cross-sectional view of the static mixer of FIG. 4, taken along line 17B-17B shown in FIG. 16;

FIG. 17C is a perspective cross-sectional view of the static mixer of FIG. 4, taken along line 17C-17C shown in FIG. 16;

FIG. 17D is a perspective cross-sectional view of the static mixer of FIG. 4, taken along line 17D-17D shown in FIG. 16;

FIG. 17E is a perspective cross-sectional view of the static mixer of FIG. 4, taken along line 17E-17E shown in FIG. 16;

FIG. 18 is a partial side view of the static mixer shown in FIG. 6.

FIG. 19A is a perspective cross-sectional view of the static mixer of FIG. 6, taken along line 19A-19A shown in FIG. 18;

FIG. 19B is a perspective cross-sectional view of the static mixer of FIG. 6, taken along line 19B-19B shown in FIG. 18;

FIG. 19C is a perspective cross-sectional view of the static mixer of FIG. 6, taken along line 19C-19C shown in FIG. 18;

FIG. 19D is a perspective cross-sectional view of the static mixer of FIG. 6, taken along line 19D-19D shown in FIG. 18;

FIG. 19E is a perspective cross-sectional view of the static mixer of FIG. 6, taken along line 19E-19E shown in FIG. 18;

FIG. 20 is a view similar to FIG. 18;

FIG. 21A is a perspective cross-sectional view of the static mixer of FIG. 6, taken along line 21A-21A shown in FIG. 20;

FIG. 21B is a perspective cross-sectional view of the static mixer of FIG. 6, taken along line 21B-21B shown in FIG. 20;

FIG. 21C is a perspective cross-sectional view of the static mixer of FIG. 6, taken along line 21C-21C shown in FIG. 20;

FIG. 21D is a perspective cross-sectional view of the static mixer of FIG. 6, taken along line 21D-21D shown in FIG. 20;

FIG. 21E is a perspective cross-sectional view of the static mixer of FIG. 6, taken along line 21E-21E shown in FIG. 20;

FIG. 22 is a partial side view of the static mixer shown in FIG. 8;

FIG. 23A is a perspective cross-sectional view of the static mixer of FIG. 8, taken along line 23A-23A shown in FIG. 22;

FIG. 23B is a perspective cross-sectional view of the static mixer of FIG. 8, taken along line 23B-23B shown in FIG. 22;

FIG. 23C is a perspective cross-sectional view of the static mixer of FIG. 8, taken along line 23C-23C shown in FIG. 22;

FIG. 23D is a perspective cross-sectional view of the static mixer of FIG. 8, taken along line 23D-23D shown in FIG. 22;

FIG. 23E is a perspective cross-sectional view of the static mixer of FIG. 8, taken along line 23E-23E shown in FIG. 22;

FIG. 24 is a view similar to FIG. 22;

FIG. 25A is a perspective cross-sectional view of the static mixer of FIG. 8, taken along line 25A-25A shown in FIG. 24;

FIG. 25B is a perspective cross-sectional view of the static mixer of FIG. 8, taken along line 25B-25B shown in FIG. 24;

FIG. 25C is a perspective cross-sectional view of the static mixer of FIG. 8, taken along line 25C-25C shown in FIG. 24;

FIG. 25D is a perspective cross-sectional view of the static mixer of FIG. 8, taken along line 25D-25D shown in FIG. 24;

FIG. 25E is a perspective cross-sectional view of the static mixer of FIG. 8, taken along line 25E-25E shown in FIG. 24;

FIG. 26 is a partial side view of the static mixer shown in FIG. 10;

FIG. 27A is a perspective cross-sectional view of the static mixer of FIG. 8, taken along line 27A-27A shown in FIG. 26;

FIG. 27B is a perspective cross-sectional view of the static mixer of FIG. 8, taken along line 27B-27B shown in FIG. 26;

FIG. 27C is a perspective cross-sectional view of the static mixer of FIG. 8, taken along line 27C-27C shown in FIG. 26;

FIG. 27D is a perspective cross-sectional view of the static mixer of FIG. 8, taken along line 27D-27D shown in FIG. 26;

FIG. 27E is a perspective cross-sectional view of the static mixer of FIG. 8, taken along line 27E-27E shown in FIG. 26;

DETAILED DESCRIPTION

Figure 1:
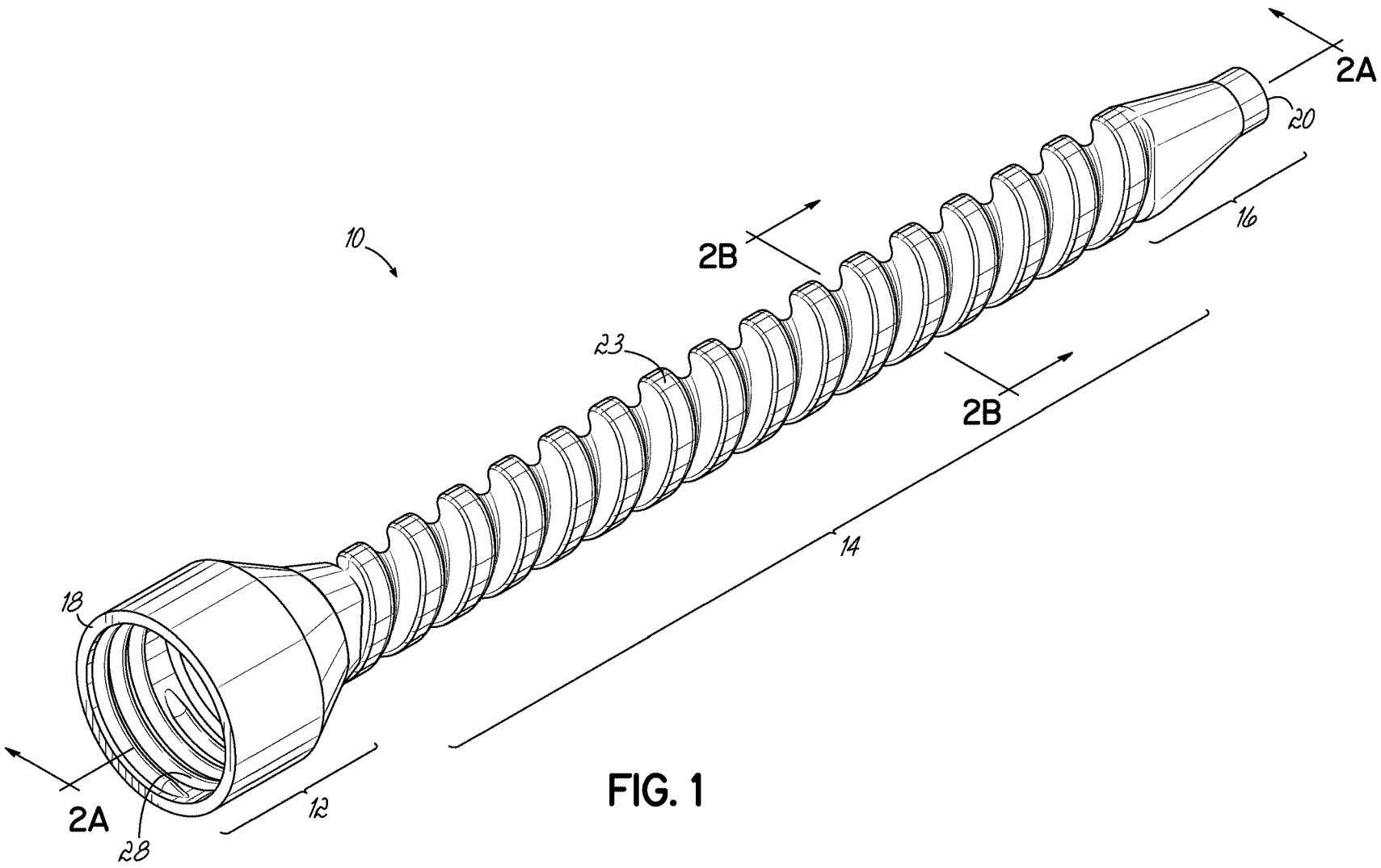
FIG. 1 is perspective view of one embodiment of a static mixer.
Figure 2B:
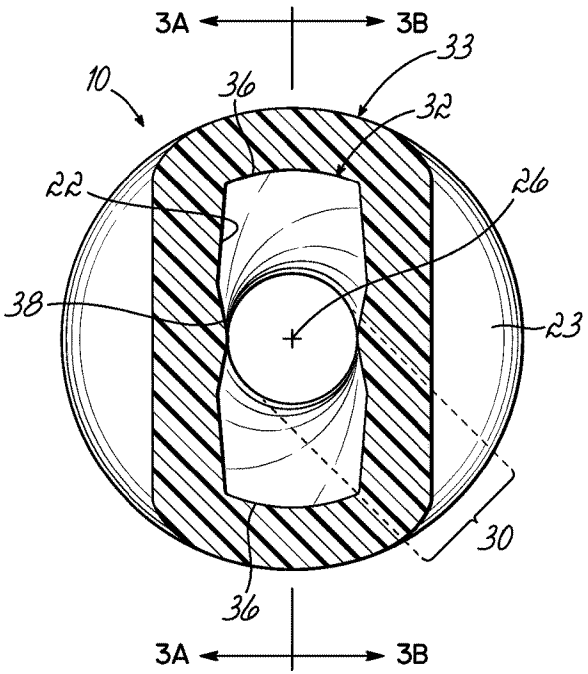
FIG. 2B is a cross-sectional view of the static mixer of FIG. 1, taken along line 2B-2B.
Figure 2A:
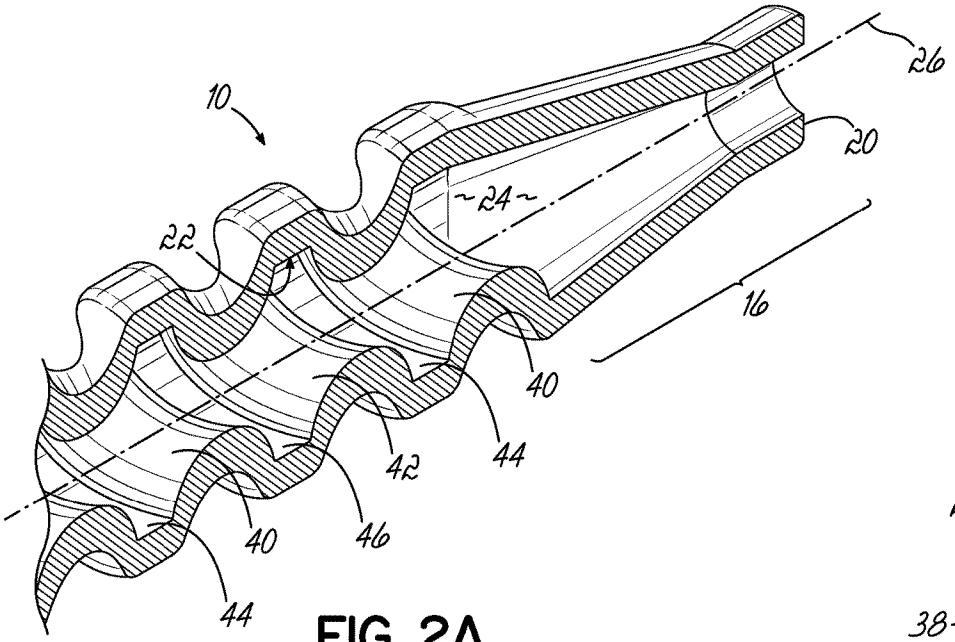
FIG. 2A is a detailed cross-sectional perspective view of the static mixer of FIG. 1, taken along line 2A-2A.

FIGS. 1 through 3B and 12 through 13E show an embodiment of a static mixer 10 including a continuous swirling pattern. The static mixer 10 is a single, unitary body and includes an inlet portion 12, a mixing portion 14, and an outlet portion 16. In that regard, the static mixer 10 includes an open proximal end 18, and open distal end 20, and an inner wall 22 therebetween. The inner wall 22 defines a conduit 24 extending along a central axis 26. The inner wall 22 includes a plurality of integrally formed convolutions defined by a plurality of undercuts (convolutions and undercuts described in more detail below) resulting from a manufacturing process such as blow molding, roto-molding, or urethane casting. The undercuts include a depth $d_1$ that prevents the static mixer 10 as shown to be made by an injection molding process. Moreover, the generally tubular configuration of the static mixer 10 prevents any side pull that may enable any injection molding process to be used to manufacture the static mixer 10.

The inlet portion 12 includes threads 28 to allow the static mixer 10 to be coupled to a source of at least one fluid (not shown). The inner wall 22, during at least a portion of the length of the mixing portion 14, includes the plurality of convolutions. As shown, none of the undercuts intersects the axis 26 and therefore a lumen portion 30 of the conduit 24 extends continuously along and coaxially relative to the central axis 26 along the entire length of the mixing portion 14.

The undercuts define a single flow path within the conduit 24. More particularly, referring specifically to FIGS. 2B and 12-13E, the undercuts define a single flow path having a shape that is formed by rotating a first shape 32 (shown in cross section) about an axis 26 in a first rotational direction as indicated by arrows 34 (clockwise as shown), while translating the first shape 32 along the central axis 26 in a flow direction towards the distal end 20. Thus, at least a portion of the flow path, in cross section, taken along a plane (not shown) that is perpendicular to the axis 26, is defined by the first shape 32. The first shape 32 is generally hourglass-shaped and includes a pair of generally curved opposing ends 36 and opposing edges 38 with multiple bends that give the first shape 32 its generally hourglass shape. In other embodiments, the first shape 32 may be a different shape. In one embodiment, the shape 33 defined the outer wall 23, taken in cross section along a plane (not shown) that is perpendicular to the central axis 26, is substantially similar to the shape 32 defined by at least a portion of the flow path taken along the same cross section.

As shown, the undercuts more particularly define a continuous swirl pattern with an opposing pair of helical first and second ridges 40, 42 and an opposing pair of first and second helical faces 44, 46. Each of the faces 44, 46 is positioned between a pair of helical ridges 40, 42. More particularly, as shown, the first face 44 is positioned between the distal portion 48 of the first ridge 40 and the proximal portion 50 of the second ridge 42. The second face 46 is positioned between the proximal portion 52 of the first ridge 40 and the distal portion 54 of the second ridge 42. Each of the faces 44, 46 includes at least a portion that is planar in cross section. In that regard, a plane (not shown) positioned tangent to either of the faces 44, 46, respectively, would be parallel to the axis 26.

Figure 3B:
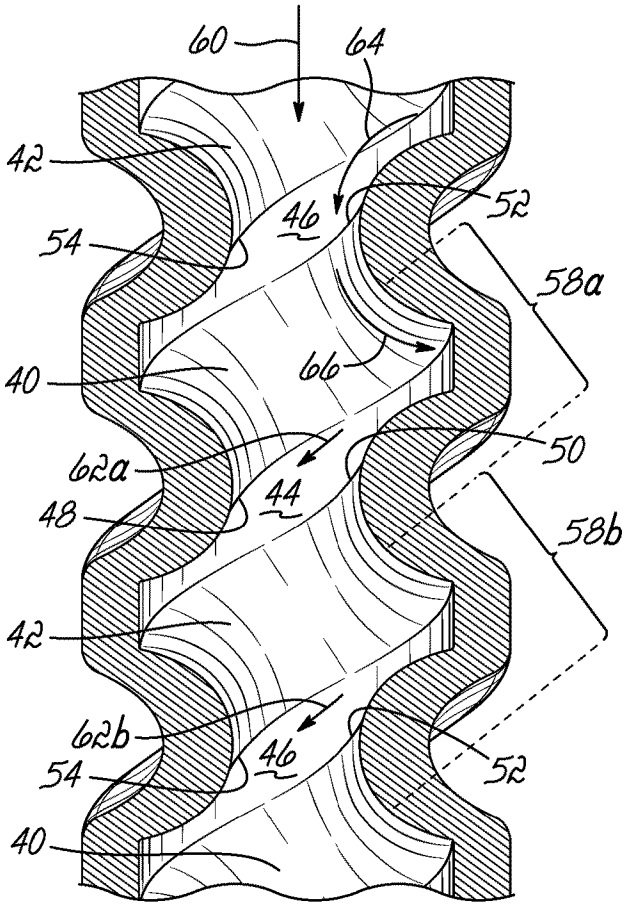
FIG. 3B is a cross-sectional view of the static mixer of FIG. 1, taken along line 3B-3B of FIG. 2B.
Figure 3A:
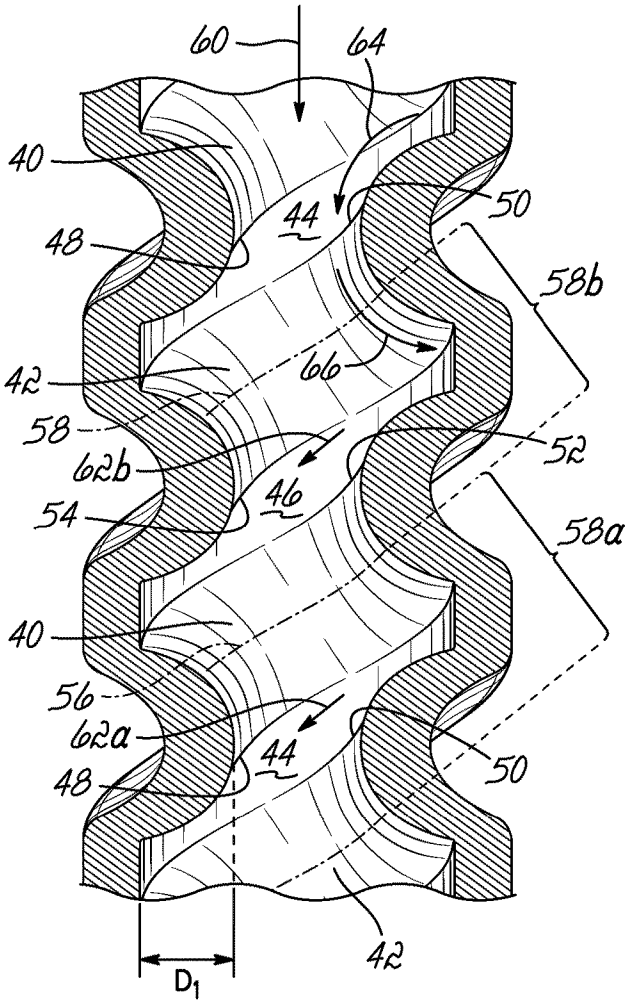
FIG. 3A is a cross-sectional view of the static mixer of FIG. 1, taken along line 3A-3A shown in FIG. 2B.

As shown best in FIGS. 3A-3B, the proximal portions 50, 52 of each ridge 42, 40 define a plurality of perimeter-to-center portions that are operative to direct the fluid flow radially towards the axis 26. Similarly, the distal portions 48, 54 of each ridge 40, 42 define a plurality of center-to-perimeter portions that are operative to direct the mass fluid flow radially away from the axis 26. The first ridge 40 is separated into the distal and proximal portions 48, 52 at an imaginary helical mid-line 56. The second ridge 42 is separated into the proximal and distal portions 50, 54 by another imaginary helical mid-line 58. Thus, the ridges 40, 42 and faces 44, 46 define first and second grooves 58*a*, 58*b*. More particularly, the first groove 58*a* is defined by the first face 44, the distal portion of the first ridge 40, and the proximal portion 50 of the second ridge 42. The second groove 58*b* is defined by the second face 46, the proximal portion 52 of the first ridge 40 and the distal portion 54 of the second ridge 42.

When a mass fluid flow of preferably two fluids (portions of which are represented by arrows described below) is introduced at the inlet portion 12, it flows through to the mixing portion 14 and traverses a single flow path defined by the inner wall 22. More particularly, the mass fluid flow flows within the single flow path in different directions, thus mixing the mass fluid flow as it flows along the single flow path. In that regard, the mass fluid flow flows axially along lumen portion 30 (arrow 60) and helically along faces 44, 46 and within grooves 58*a*, 58*b* (arrows 62*a*, 62*b*). Moreover, a portion of the mass fluid flow flows radially inward along the proximal perimeter-to-center portions 52, 50 of ridges 40, 42 (arrows 64), radially outward along distal center-to-perimeter portions 48, 54 of the ridges 40, 42 (arrows 66). These portions of flow flowing in different directions within the single flow path interact and cause mixing of the mass fluid flow along the mixing portion 14. Once sufficiently mixed, the at least one fluid may be dispensed from the outlet portion 16.

FIGS. 8 through 9D and 22 through 25E show a static mixer 10' according to an alternative embodiment of the continuous spiral embodiment. Because a portion of this embodiment is similar to the previous embodiment, similar structures are labeled with the same reference numerals without further explanation. The static mixer 10' is a single unitary body. The mixing portion 14 includes a single flow path with a continuous swirl shape, similar to the previous embodiment. However, the direction of rotation of the flow path reverses directions at a certain point along the flow path, as described in more detail below. The undercuts include a depth $d_1$, that prevents the static mixer 10' as shown to be made by an injection molding process.

In that regard, the undercuts define a single flow path having a first flow path portion 68 and a second flow path portion 70. As shown best in FIGS. 23A-23E, the first flow path portion 68 is formed by rotating the first shape 32 about the central axis 26 in a first rotational direction (arrow 72) (clockwise as shown), while translating the first shape along the axis 26 in a flow direction (from the proximal end 18 to distal end 20). The flow path, in cross section, taken along a plane (not shown) that is perpendicular to the axis 26, is defined by the first shape 32. In other embodiments, the first shape 32 may be a different shape. After a certain length, the direction of rotation is reversed to a second rotational direction (arrow 74) to form the second flow path portion 70 (as shown best in FIGS. 25A-25E). Therefore, the second flow path portion 70 is formed by rotating the first shape 32 (in cross section) about the central axis 26 in the second rotational direction (counterclockwise as shown), while translating the first shape 32 along the axis 26 in the flow direction. In one embodiment, the shape defined by the outer wall, taken in cross section along a plane (not shown) that is perpendicular to the central axis, is substantially similar to the shape defined by at least a portion of the flow path taken along the same cross section.

The second flow path portion 70 is substantially similar to the flow path described with respect to the embodiment of FIG. 1. The first flow path portion 68 is also substantially similar to the flow path described with respect to the embodiment of FIG. 1, except for that the rotational configuration is opposite.

In that regard, the first flow path portion 68 includes an opposing pair of third and fourth helical ridges 40', 42' and an opposing pair of third and fourth helical faces 44', 46'. Each of the faces 44', 46' includes at least a portion that is planar in cross section. In that regard, a plane (not shown) positioned tangent to the each of the faces 44', 46', respectively, would be parallel to the axis 26.

The proximal portions 50', 52' of each ridge 42', 40' define a plurality of perimeter-to-center portions that are operative to direct the fluid flow radially inward towards the axis 26. Similarly, the distal portions 48', 54' of each ridge 40', 42' define a plurality of center-to-perimeter portions that are operative to direct the mass fluid flow radially away from the axis 26. The first ridge 40' is separated into the distal and proximal portions 48', 52' at an imaginary helical mid-line 56', while the second ridge 42' is separated into the proximal and distal portions 50', 54' by another imaginary helical mid-line 58'. A first groove 58*a*' is defined by the first face 44', the distal portion of the first ridge 40', and the proximal portion 50' of the second ridge 42'. A second groove 58*b*' is defined by the second face 46', the proximal portion 52' of the first ridge 40' and the distal portion 54' of the second ridge 42'.

When a mass fluid flow of preferably two fluids is introduced at the inlet portion 12, it flows through to the mixing portion 14 and traverses a single flow path defined by the inner wall 22. The mass fluid flow flows within the single flow path in different directions, thus mixing the mass fluid flow as it flows along the single flow path. More particularly, the mass fluid flow flows into the first flow path portion 68, whereby it is mixed. In that regard, the mass fluid flow flows axially along lumen portion 30 (arrow 60) and helically along faces 44', 46' and within grooves 58*a*', 58*b*' (arrows 62*a*', 62*b*'). Moreover, a portion of the mass fluid flow flows radially inward along the proximal perimeter-to-center portions 52', 50' of ridges 40', 42' (arrows 64'), radially outward along distal center-to-perimeter portions 48', 54' of the ridges 40', 42' (arrows 66'). These portions of flow flowing in different directions within the single flow path interact and cause mixing of the mass fluid flow along at least the mixing portion 14.

The mass fluid flow then flows into the second flow path portion 70. In that regard, the mass fluid flow flows axially along lumen portion 30 (arrow 60) and helically along faces 44, 46 (2, 4) and within grooves 58*a*, 58*b* (arrows 62). Moreover, a portion of the mass fluid flow flows radially inward along the proximal perimeter-to-center portions 52, 50 of ridges 40, 42 (arrows 64), radially outward along distal center-to-perimeter portions 48, 54 of the ridges 40, 42 (arrows 66). These portions of flow flowing in different directions within the single flow path interact and cause mixing of the mass fluid flow along the mixing portion 14. The sufficiently mixed mass fluid flow may then be dispensed from outlet portion 16. Of course, the mixing portion 14 may include only portions of certain features described herein at transition points between the mixing portion 14 and the inlet and outlet portions 12, 16, respectively (i.e., where the inlet portion 12 ends and the mixing portion 14 begins, or where the mixing portion 14 ends and the outlet portion 16 begins). Once sufficiently mixed, the at least one fluid may be dispensed from the outlet portion 16.

FIGS. 4 through 5D, and 14 through 17E show an alternative embodiment of a static mixer 110 including an alternating spiral configuration. The static mixer 110 is a single unitary body and includes an inlet portion 112, a mixing portion 114, and an outlet portion 116. As shown, the static mixer 110 includes an open proximal end 118, and open distal end 120, and an inner wall 122. The static mixer also includes an outer wall 123. The inner wall 122 defines a conduit 124 extending along a central axis 126. The inlet portion 112 includes threads 128 to allow the static mixer 110 to be coupled to a source of at least one fluid (not shown). The inner wall 122, during at least a portion of the length of the mixing portion 14, includes a plurality of integrally formed convolutions defined by a plurality of undercuts (the convolutions and undercuts are described in more detail below). The undercuts are a result of manufacturing process such as blow molding, roto-molding, or urethane casting. The undercuts include a depth $d_2$ that prevents the static mixer 110 as shown to be made by an injection molding process. Moreover, the generally tubular configuration of the static mixer 10 prevents any side pull that may enable such undercuts. As shown, none of the undercuts intersects the axis 126 and therefore a lumen portion 130 of the conduit extends continuously along and coaxially relative to the central axis 126 along the entire length of the mixing portion 114.

As shown, the undercuts define a single flow path including a first flow path portion 132 and a second flow path portion 134 that repeat along the length of the mixing portion 114. Of course, the mixing portion may include only portions of the first and/or second flow path portions 132, 134 at the beginning and the end of the mixing portion 114. Referring specifically to FIGS. 14 through 15E, the first flow path portion 132 is formed by rotating a generally rectangular shape 136 (in cross section) about an axis 126 in a first rotational direction (arrow 138) (clockwise as shown) 180 degrees, while translating the generally rectangular shape 136 along the axis 126 in a flow direction. Thus, the first flow path portion 132, in cross section, taken along a plane (not shown) that is perpendicular to the axis 126, is generally rectangular in shape and includes a pair of straight opposing edges 140 and a pair of curved opposing edges 142 therebetween. The second flow path portion 134 includes a substantially similar shape as the first flow path portion 132. The second flow path portion 134 is formed by rotating a generally rectangular shape 136 along the axis 126 in a second rotational direction (arrows 143) (counterclockwise as shown in FIGS. 16-17E) 180 degrees while translating the generally rectangular shape 136 along the axis 126. Thus, the second flow path portion 134, in cross section, taken along a plane that is perpendicular to the axis 126, also is generally rectangular in shape and includes a pair of straight opposing edges 140 and a pair of curved opposing edges 142 therebetween.

Figure 4:
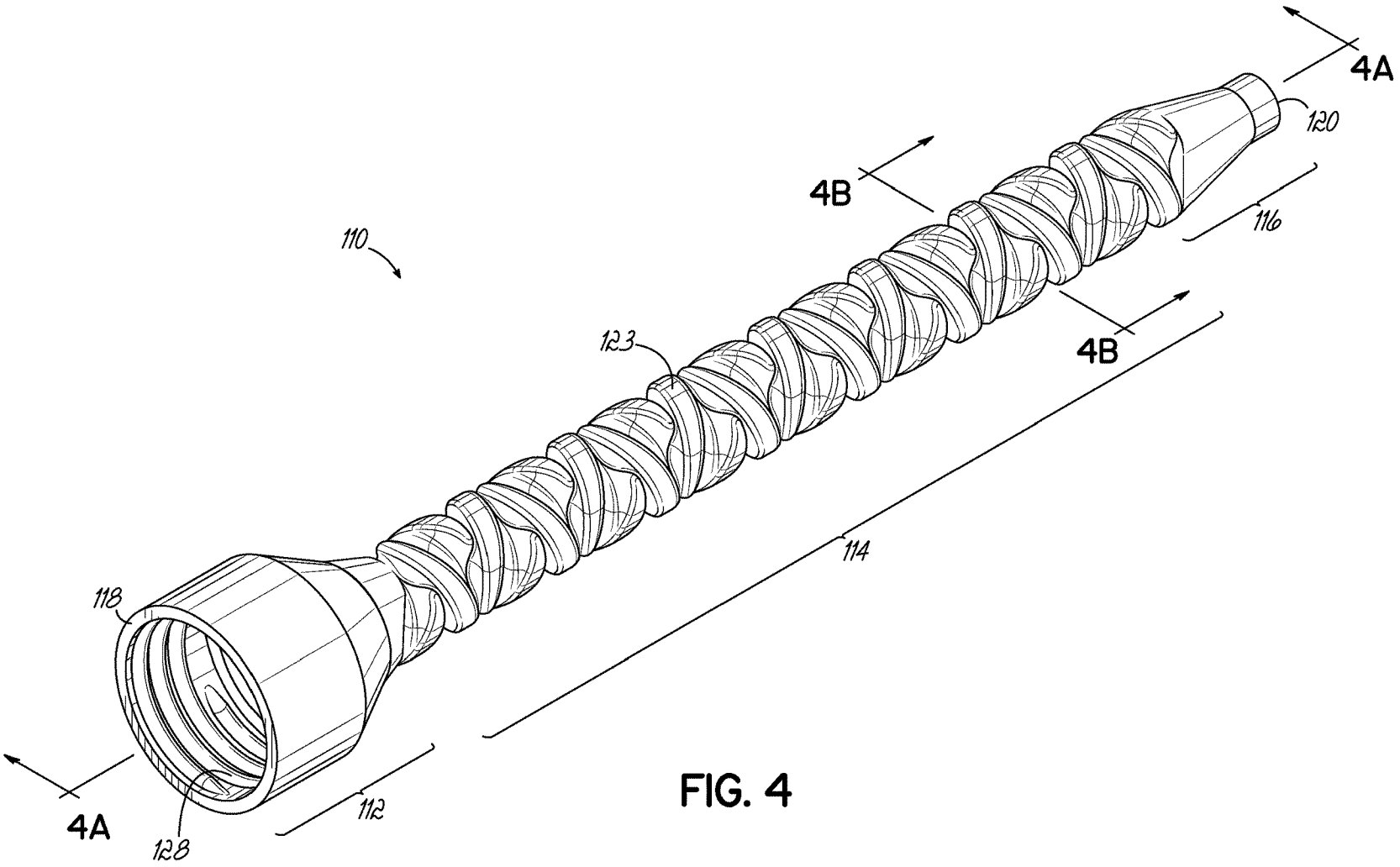
FIG. 4 is perspective view of an alternative embodiment of a static mixer.
Figure 4A:
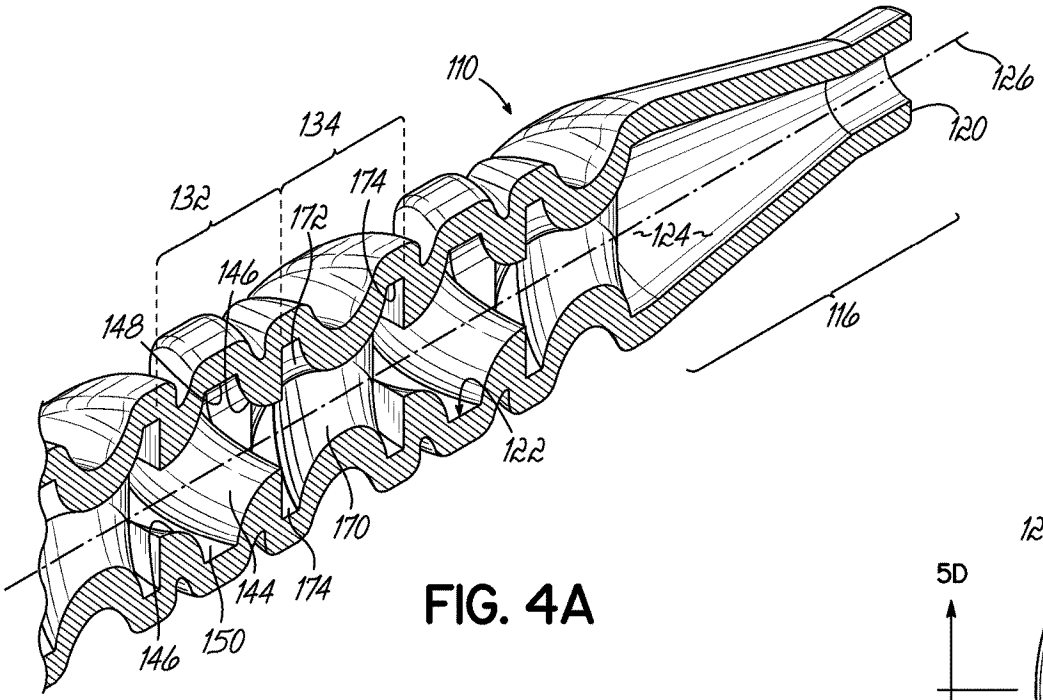
FIG. 4A is a detailed cross-sectional perspective view of the static mixer of FIG. 4, taken along line 4A-4A.
Figure 4B:
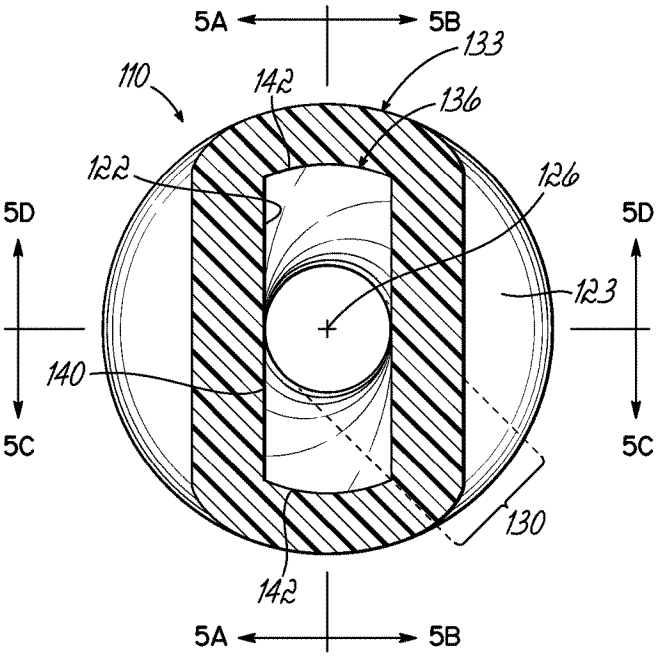
FIG. 4B is a cross-sectional view of the static mixer of FIG. 4, taken along line 4B-4B.
Figure 5B:
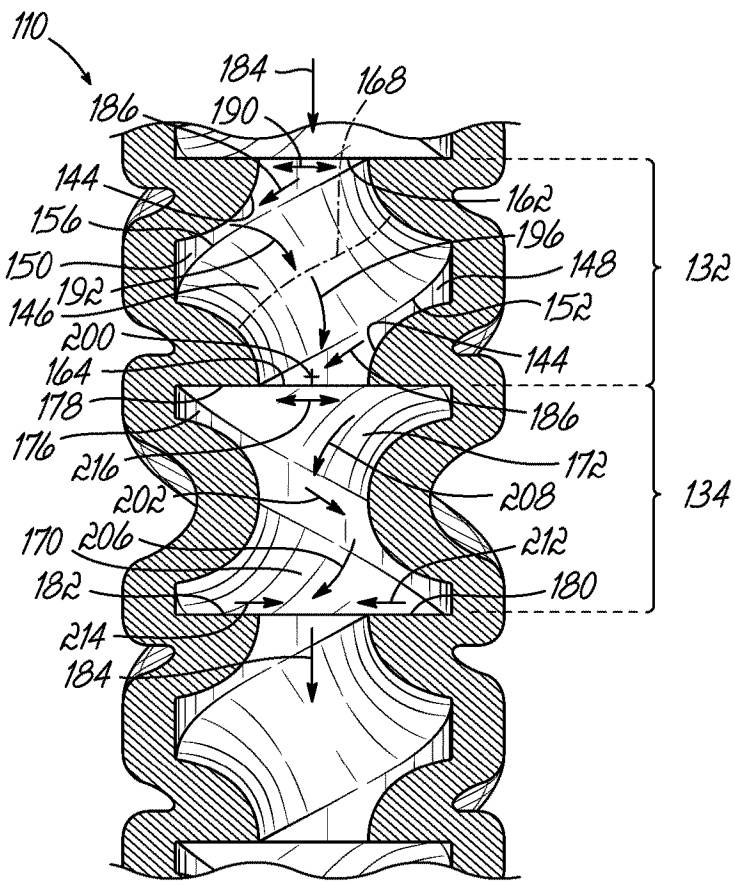
FIG. 5B is a cross-sectional view of the static mixer of FIG. 4, taken along line 5B-5B shown in FIG. 4B.
Figure 5A:
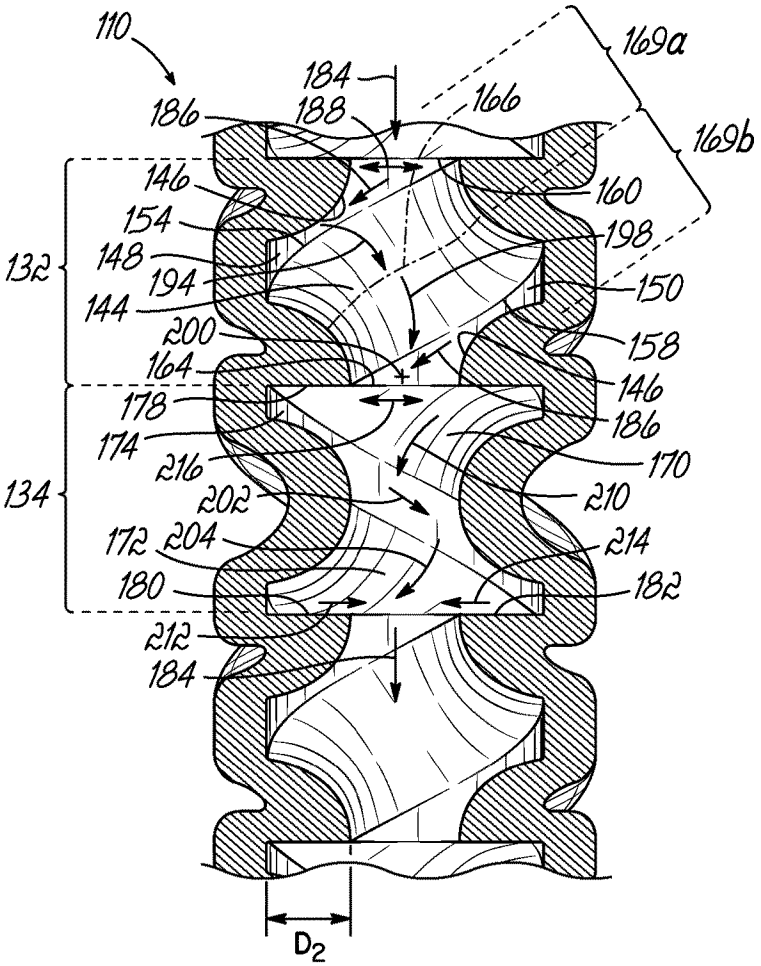
FIG. 5A is a cross-sectional view of the static mixer of FIG. 4, taken along line 5A-5A shown in FIG. 4B.
Figure 5D:
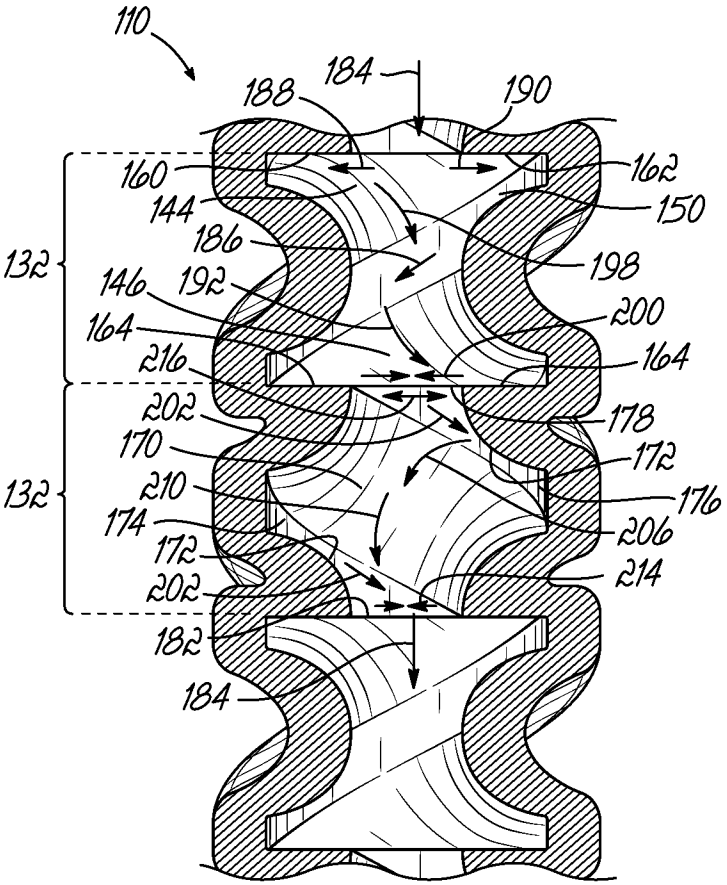
FIG. 5D is a cross-sectional view of the static mixer of FIG. 4, taken along line 5D-5D shown in FIG. 4B.
Figure 5C:
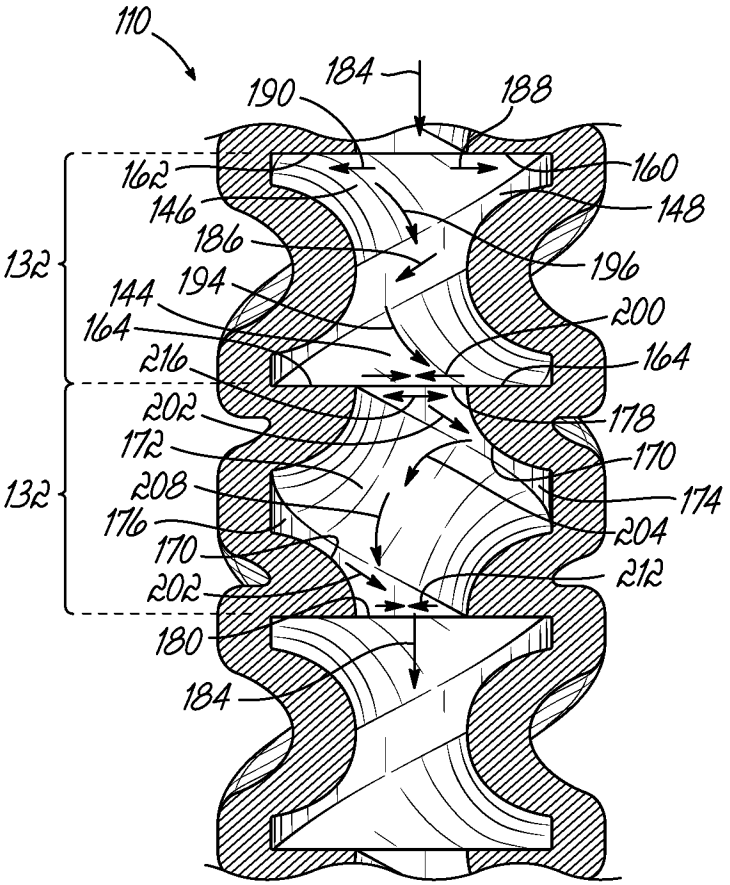
FIG. 5C is a cross-sectional view of the static mixer of FIG. 4, taken along line 5C-5C shown in FIG. 4B.
Figure 6:
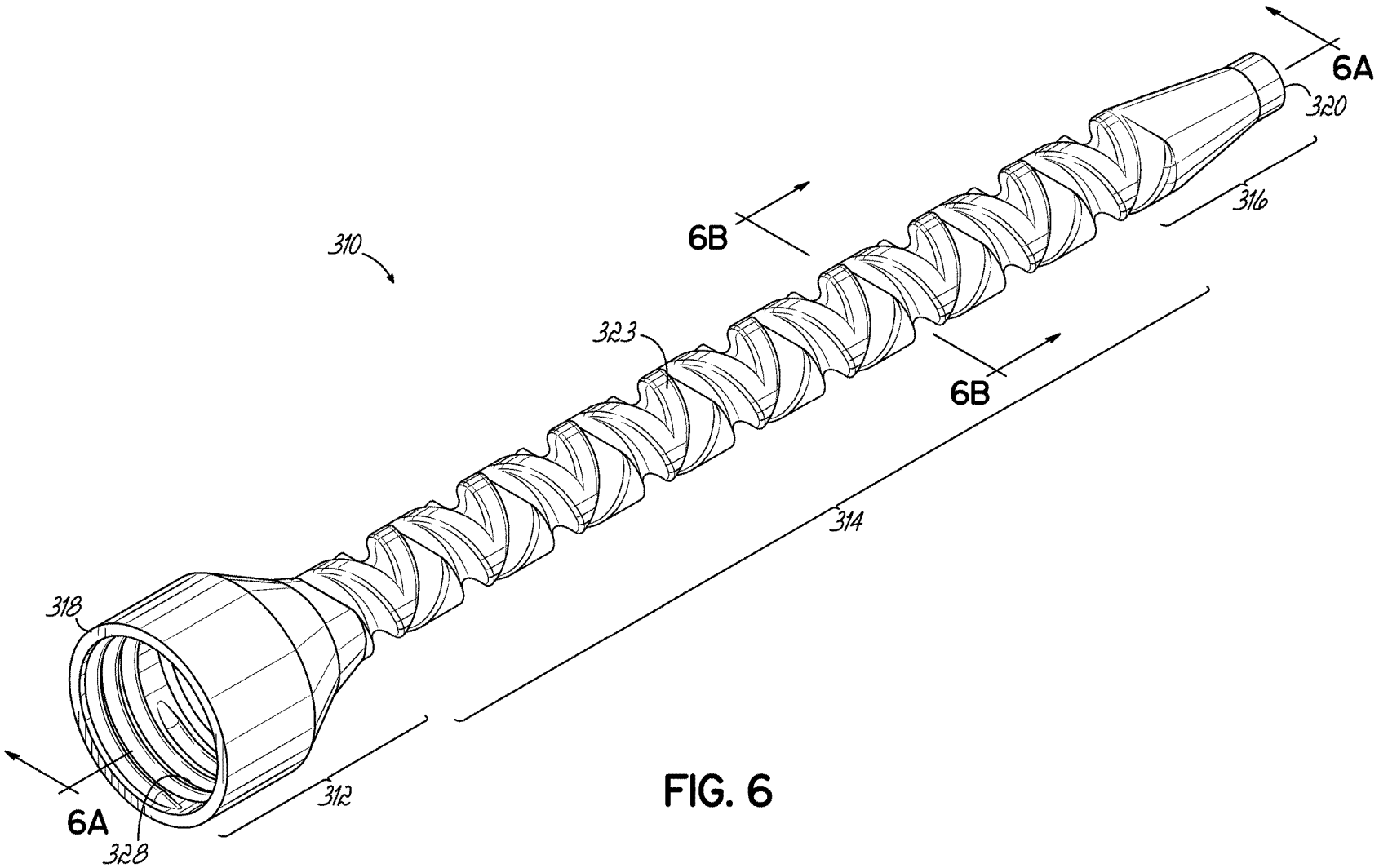
FIG. 6 is perspective view of an alternative embodiment of a static mixer.
Figure 6B:
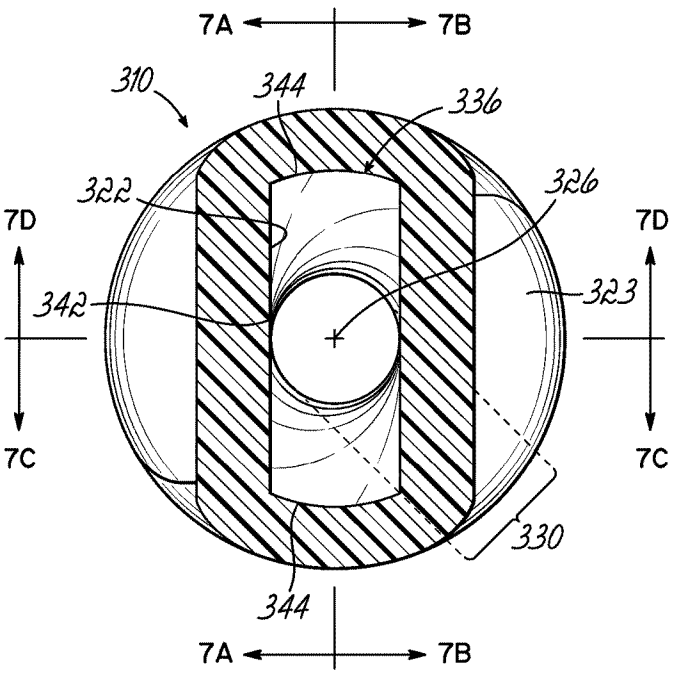
FIG. 6B is a cross-sectional view of the static mixer of FIG. 6, taken along line 6B-6B.
Figure 6A:
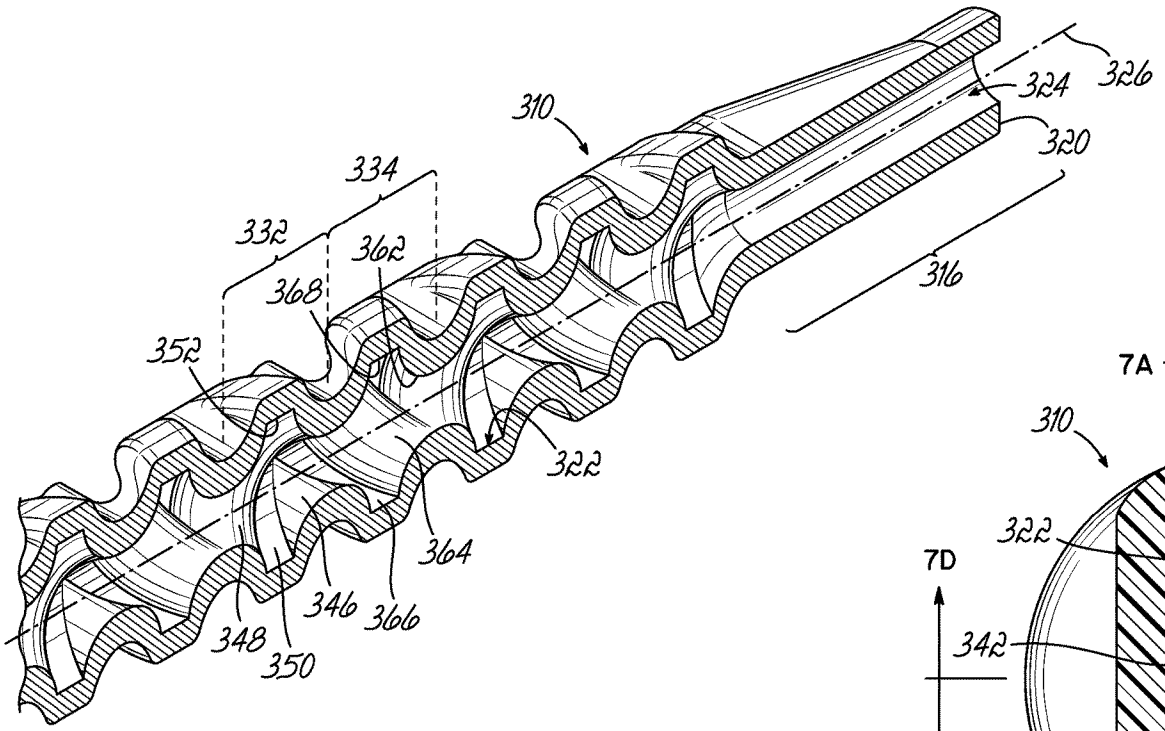
FIG. 6A is a detailed cross-sectional perspective view of the static mixer of FIG. 6, taken along line 6A-6A.
Figure 7B:
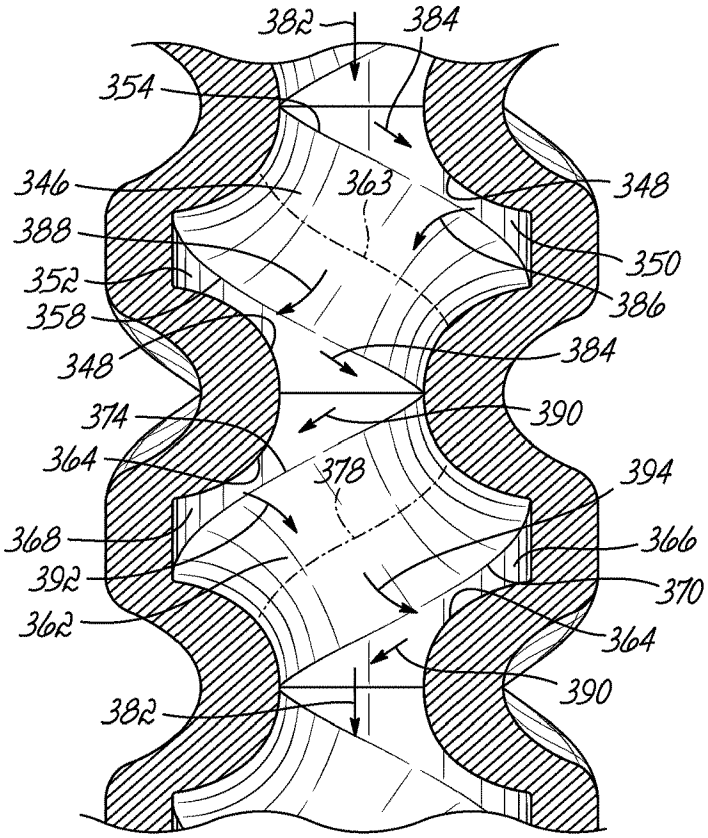
FIG. 7B is a cross-sectional view of the static mixer of FIG. 6, taken along line 7B-7B shown in FIG. 6B.
Figure 7A:
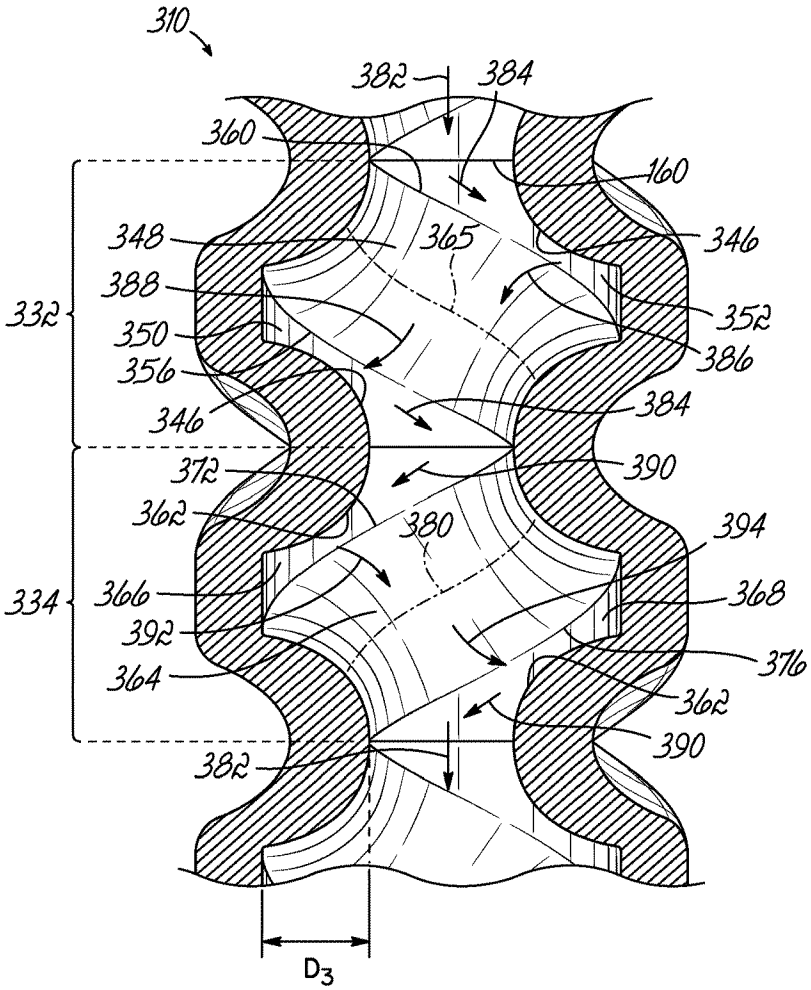
FIG. 7A is a cross-sectional view of the static mixer of FIG. 6, taken along line 7A-7A shown in FIG. 6B.
Figure 7D:
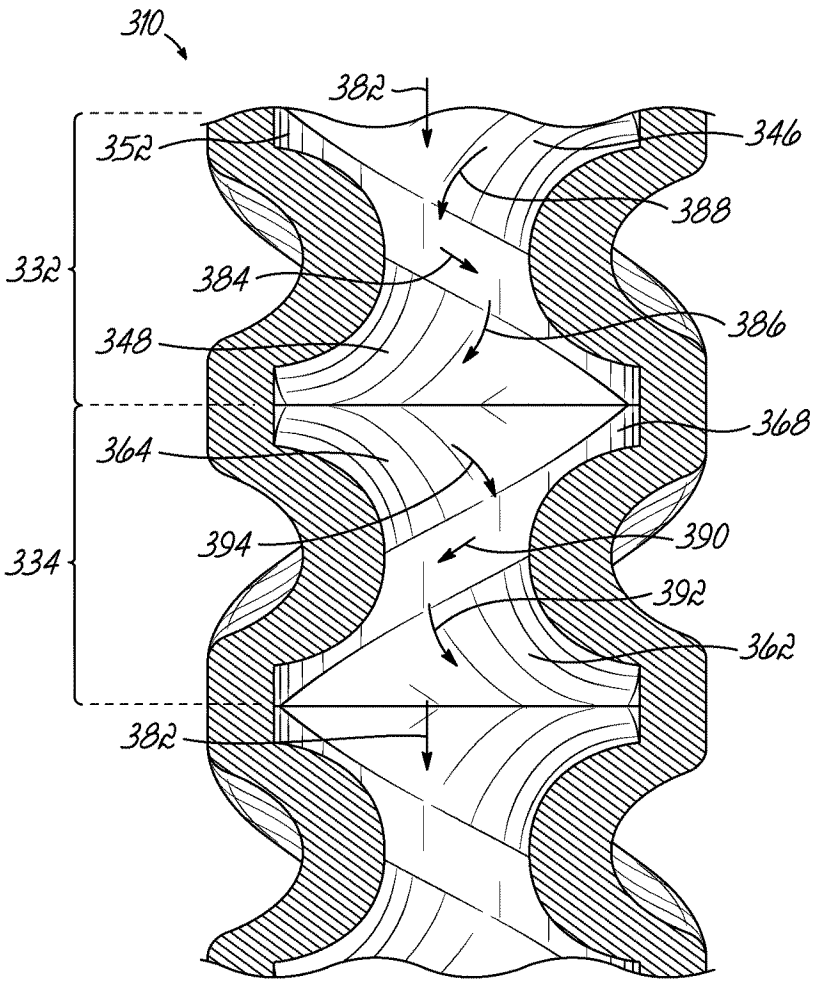
FIG. 7D is a cross-sectional view of the static mixer of FIG. 6, taken along line 7D-7D shown in FIG. 6B.
Figure 7C:
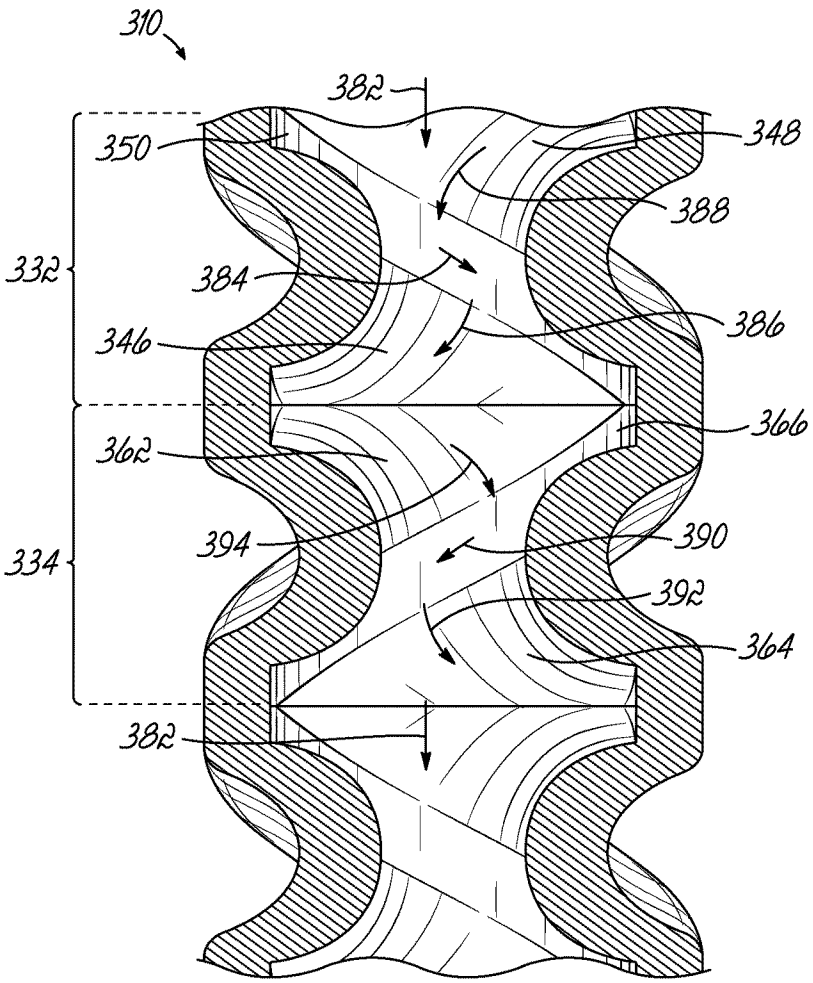
FIG. 7C is a cross-sectional view of the static mixer of FIG. 6, taken along line 7C-7C shown in FIG. 6B.
Figure 8:
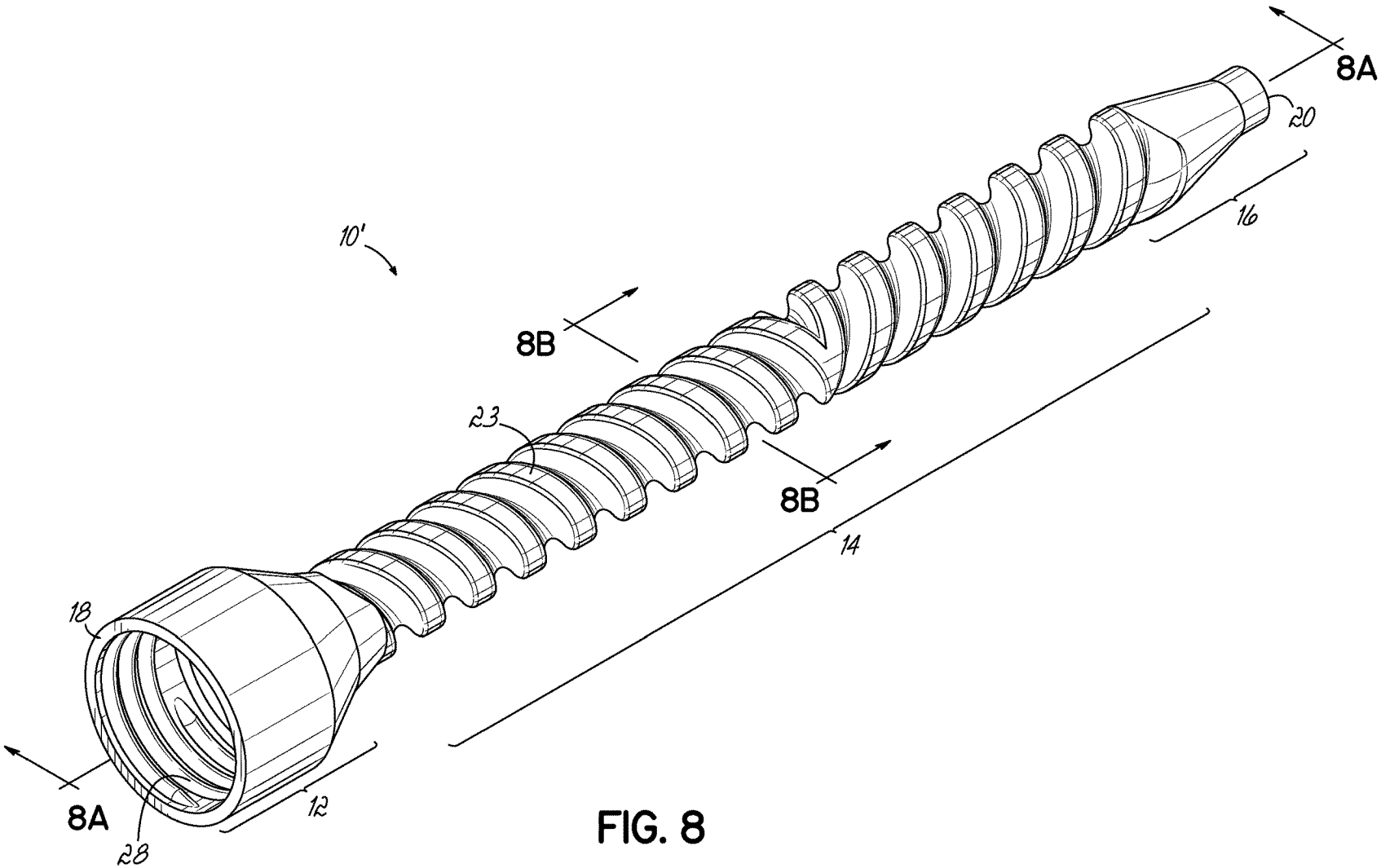
FIG. 8 is perspective view of another alternative embodiment of a static mixer.
Figure 8B:
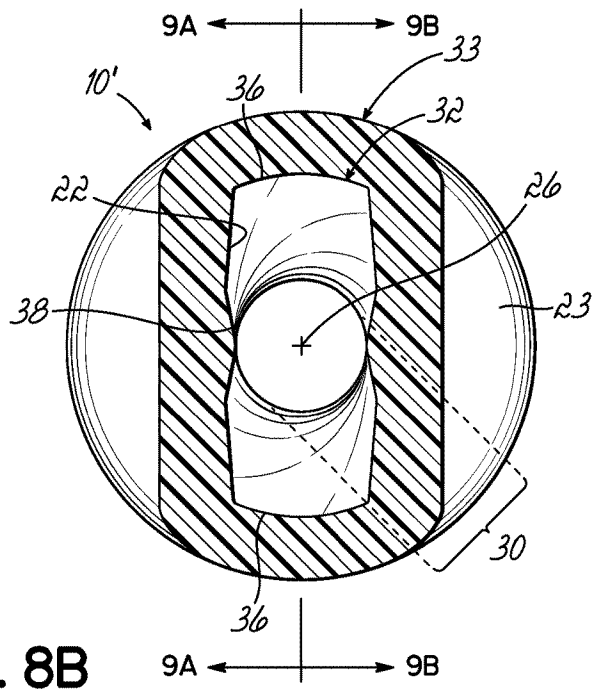
FIG. 8B is a cross-sectional view of the static mixer of FIG. 8, taken along line 8B-8B.
Figure 8A:
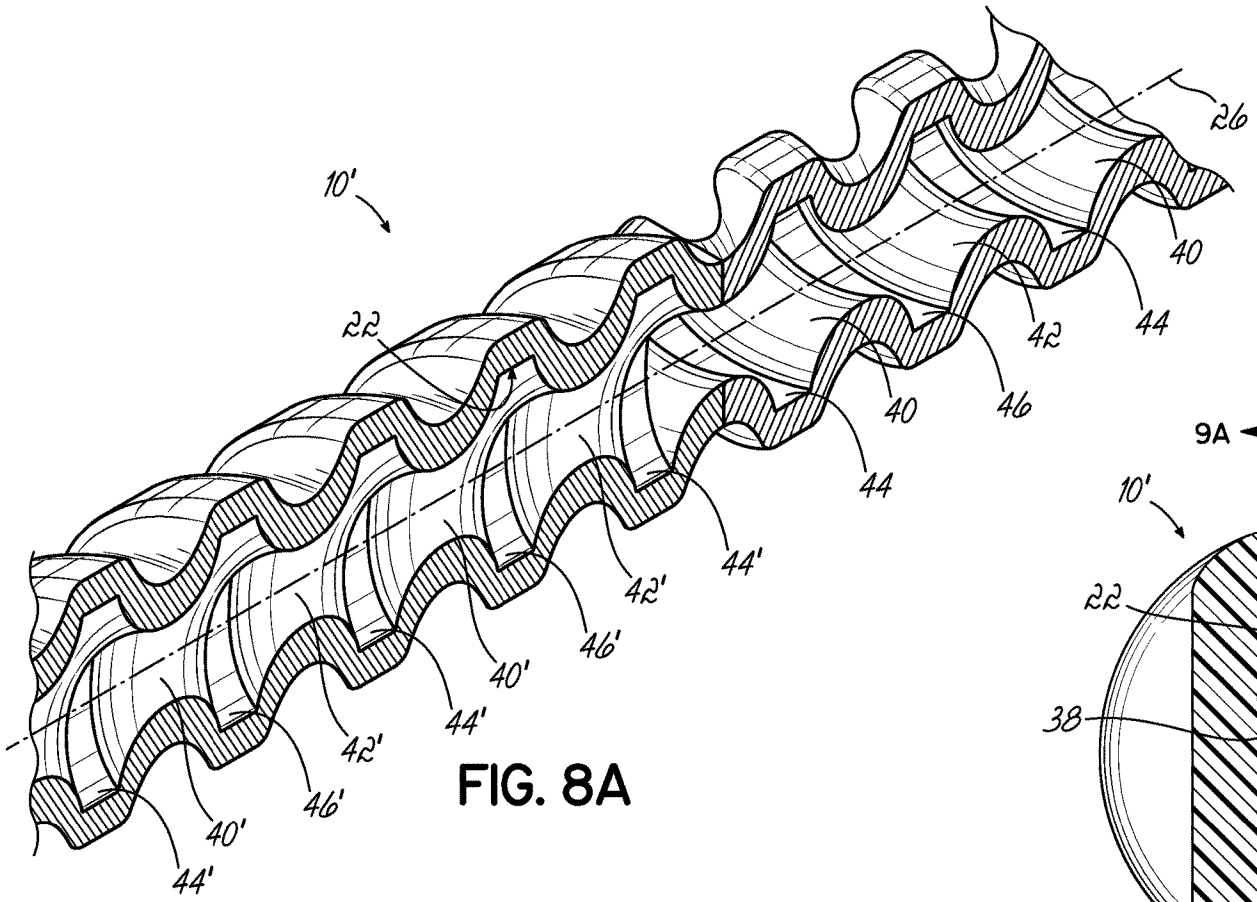
FIG. 8A is a detailed cross-sectional perspective view of the static mixer of FIG. 8, taken along line 8A-8A.
Figure 9B:
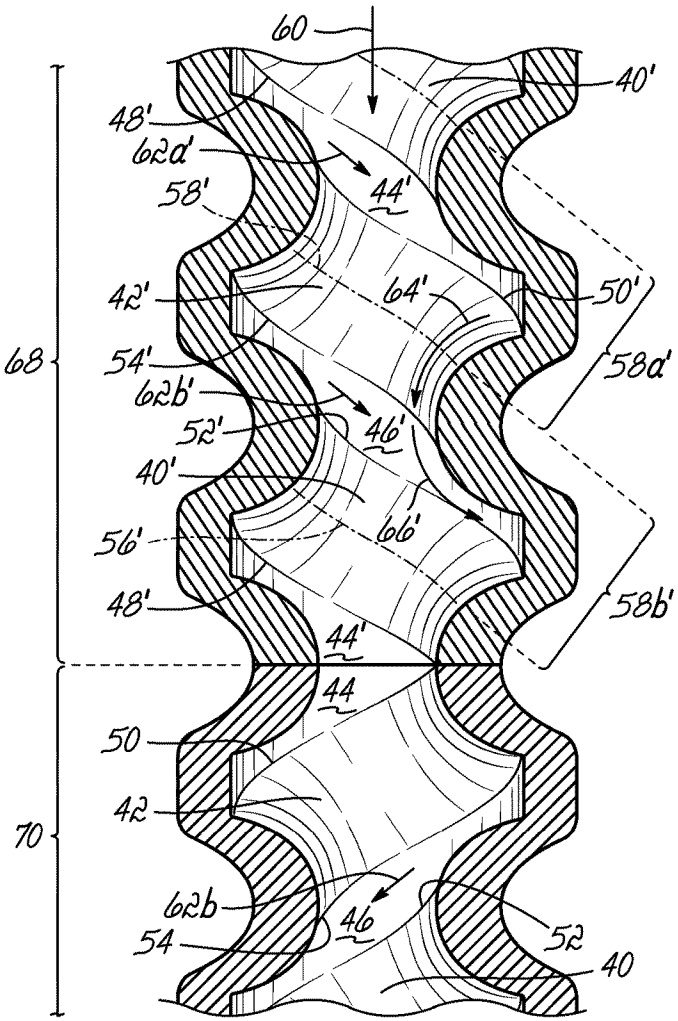
FIG. 9B is a cross-sectional view of the static mixer of FIG. 8, taken along line 9B-9B shown in FIG. 8B.
Figure 9A:
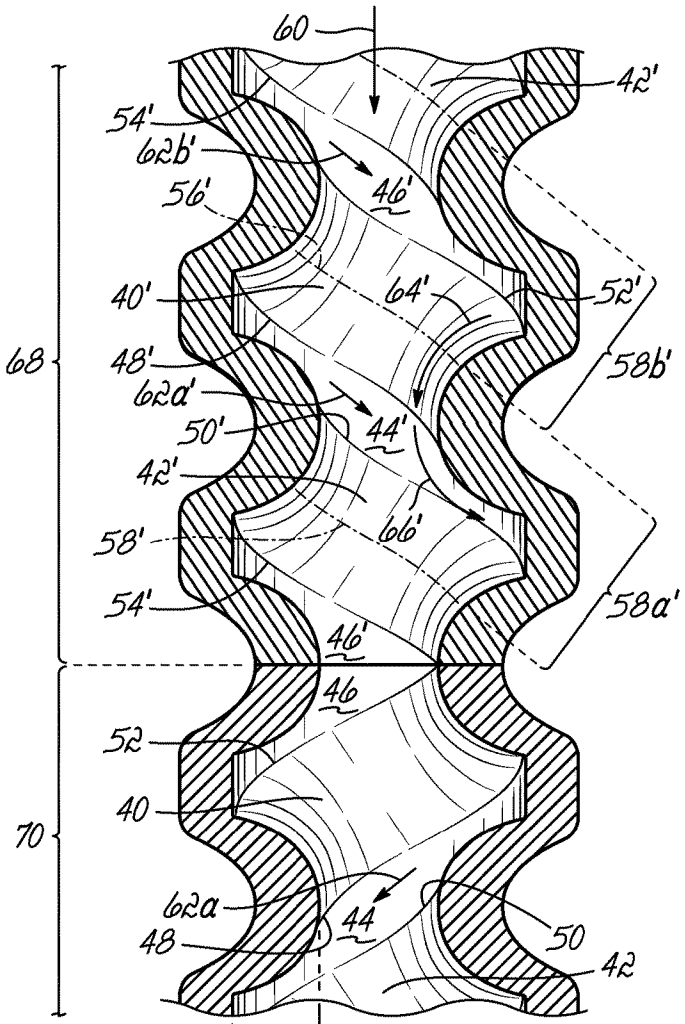
FIG. 9A is a cross-sectional view of the static mixer of FIG. 8, taken along line 9A-9A shown in FIG. 8B.
Figure 10:
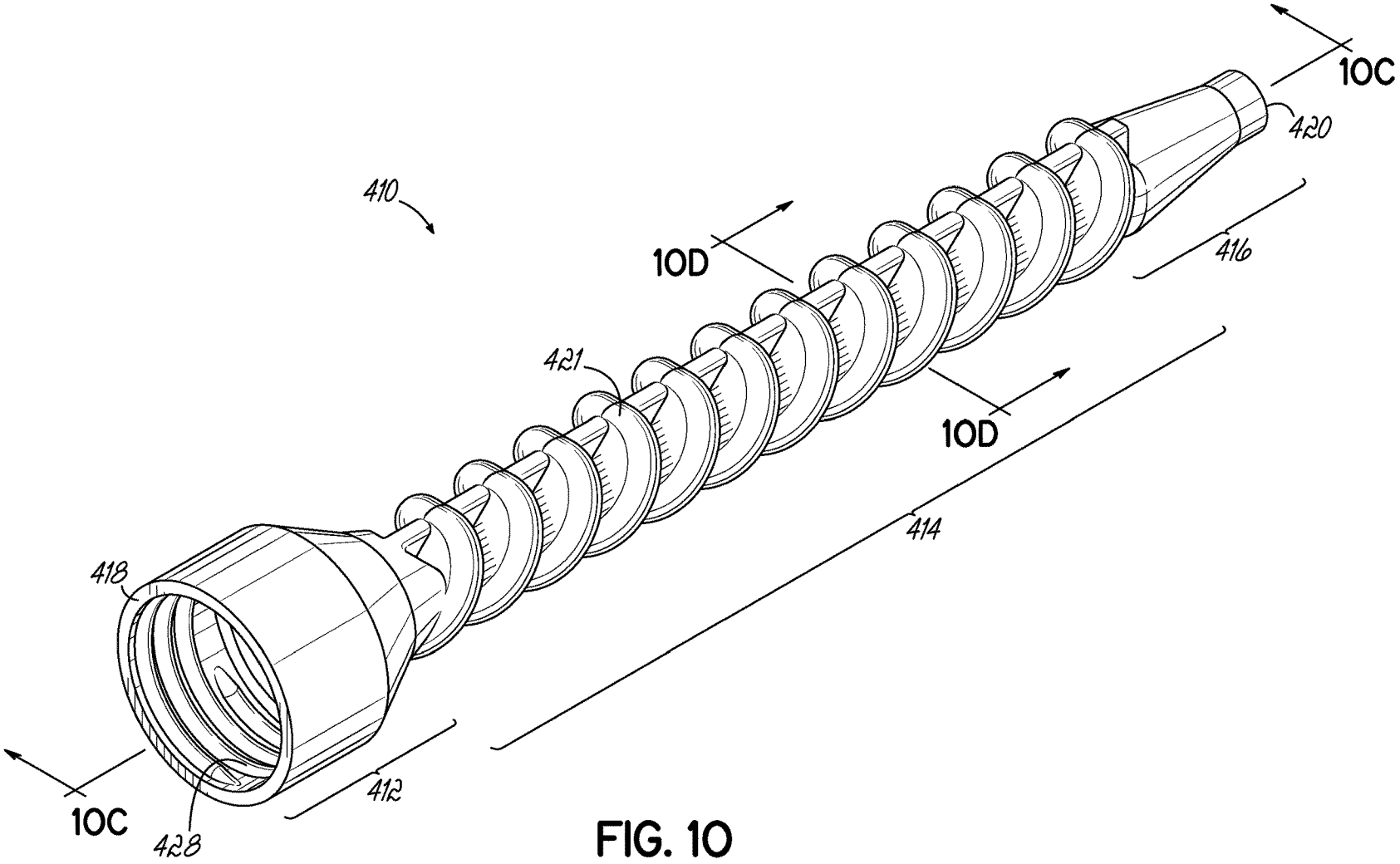
FIG. 10 is a perspective view of another alternative embodiment of a static mixer.
Figure 10A:
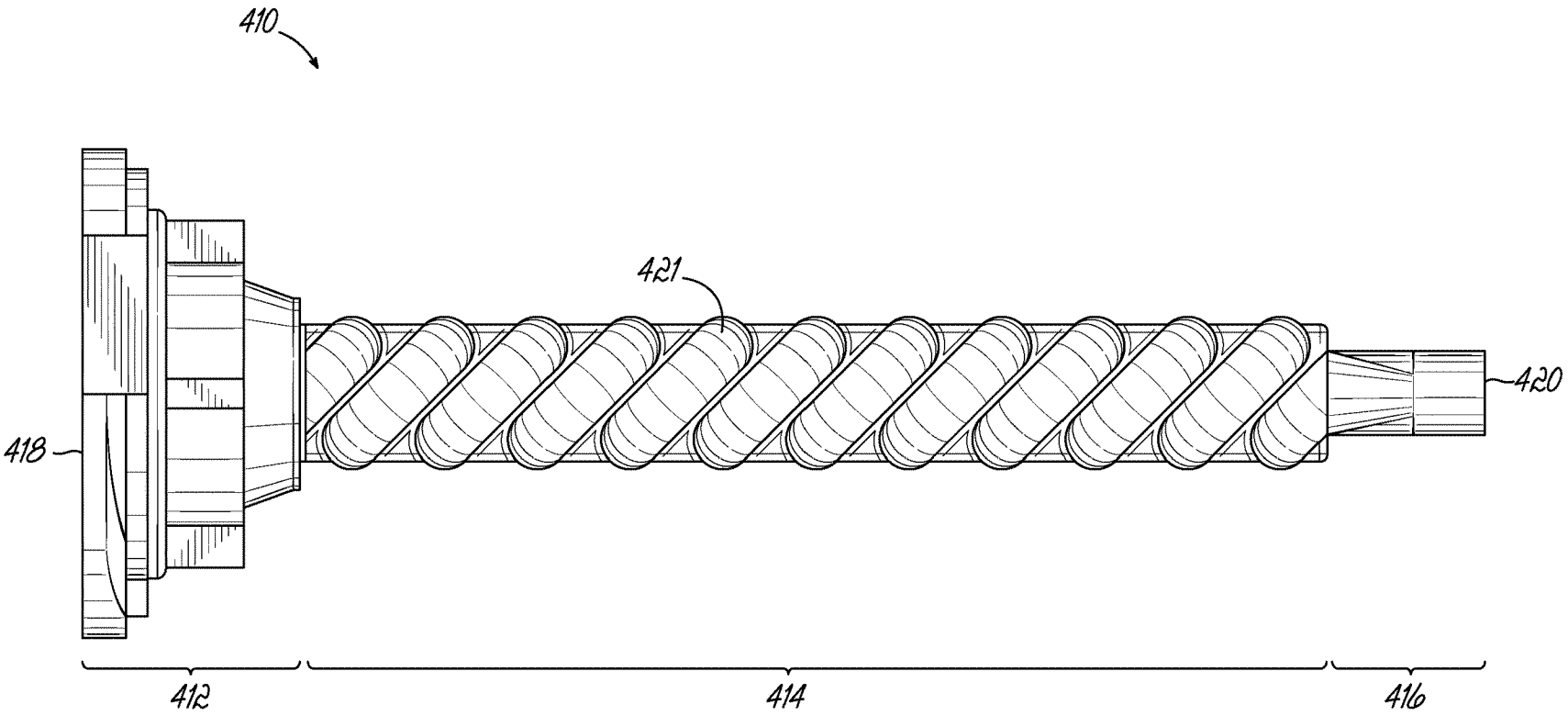
FIG. 10A is a side view of the static mixer of FIG. 10.
Figure 10B:
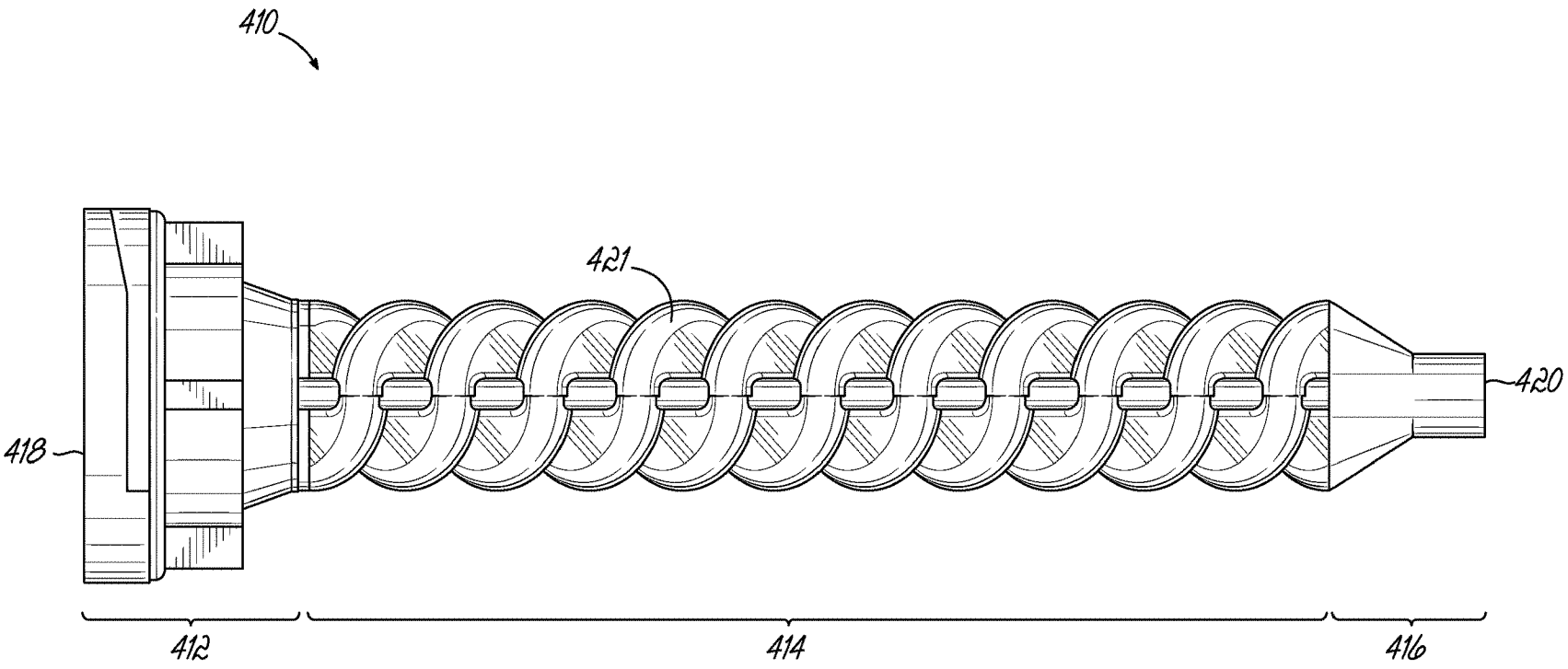
FIG. 10B is a front view of the static mixer of FIG. 10.
Figure 10C:
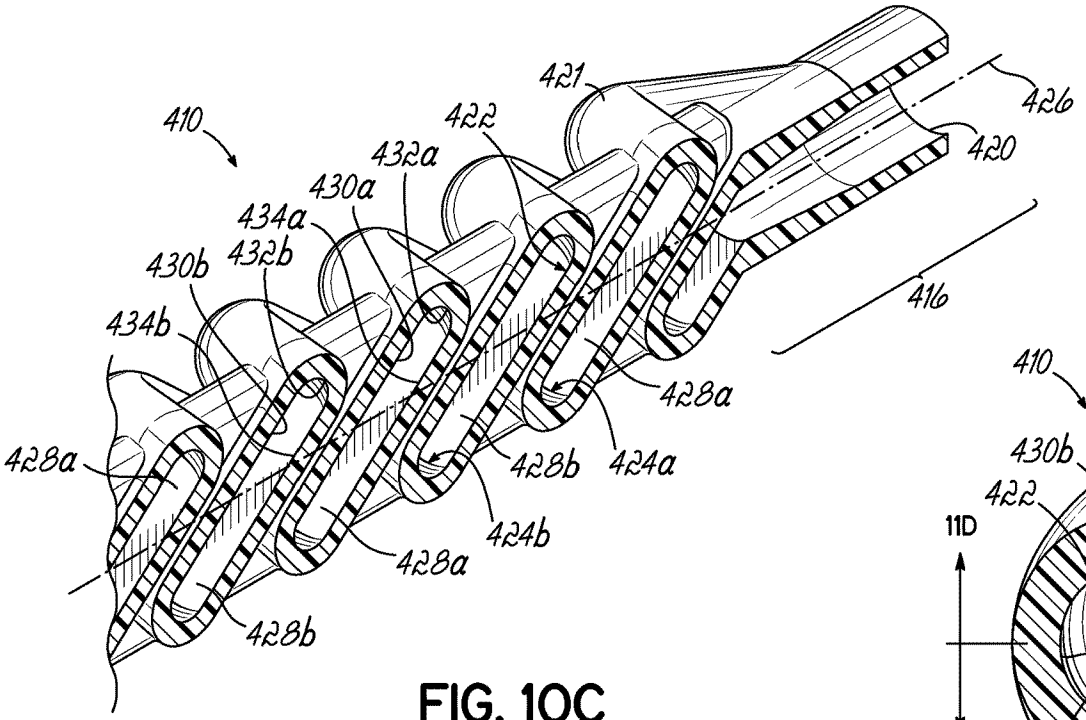
FIG. 10C is a cross-sectional view of the static mixer of FIG. 10, taken along line 10C-10C.
Figure 10D:
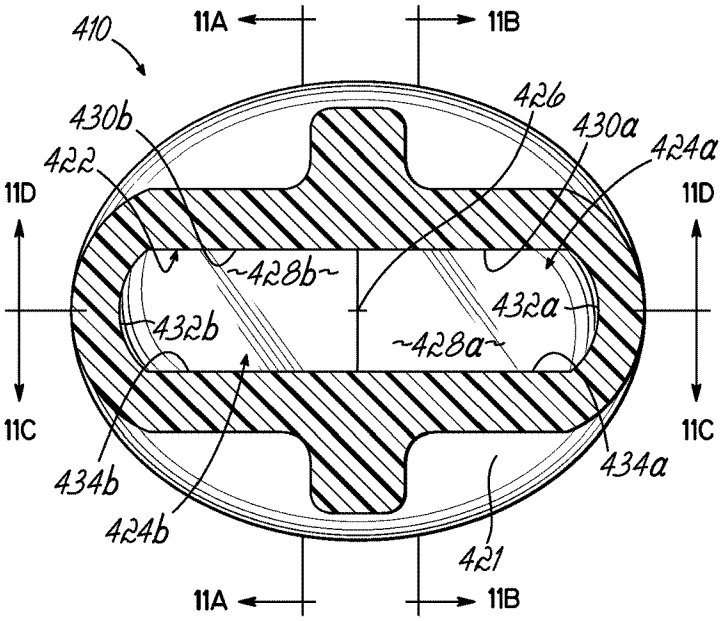
FIG. 10D is a cross-sectional view of the static mixer of FIG. 10, taken along line 10D-10D.
Figure 11B:
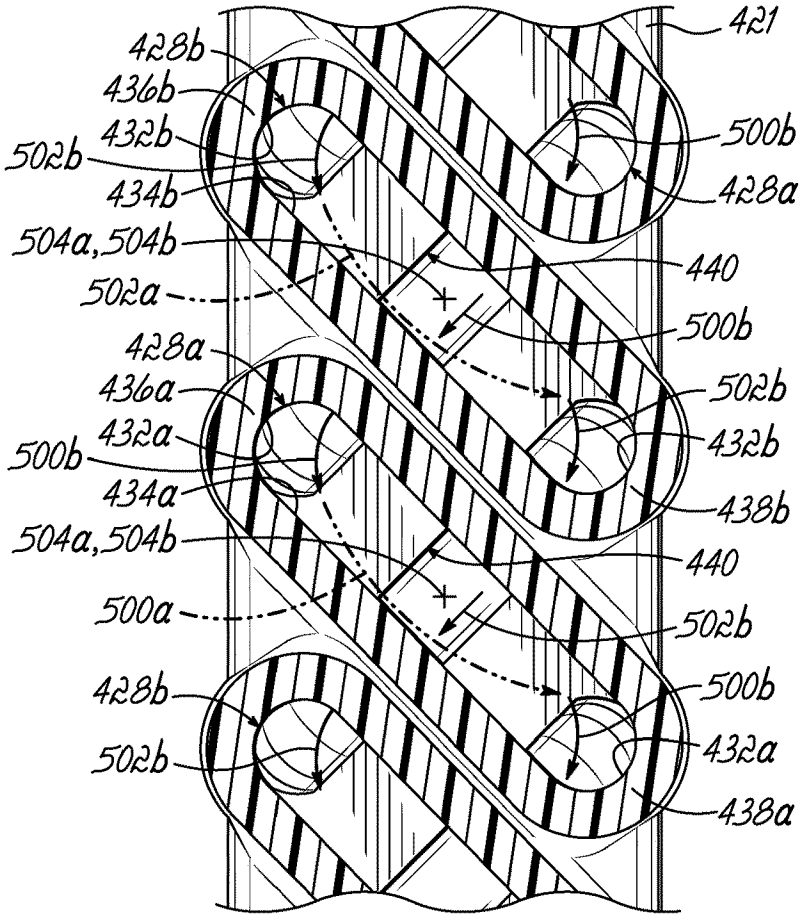
FIG. 11B is a cross-sectional view of the static mixer of FIG. 10, taken along line 11B-11B shown in FIG. 10D
Figure 11A:
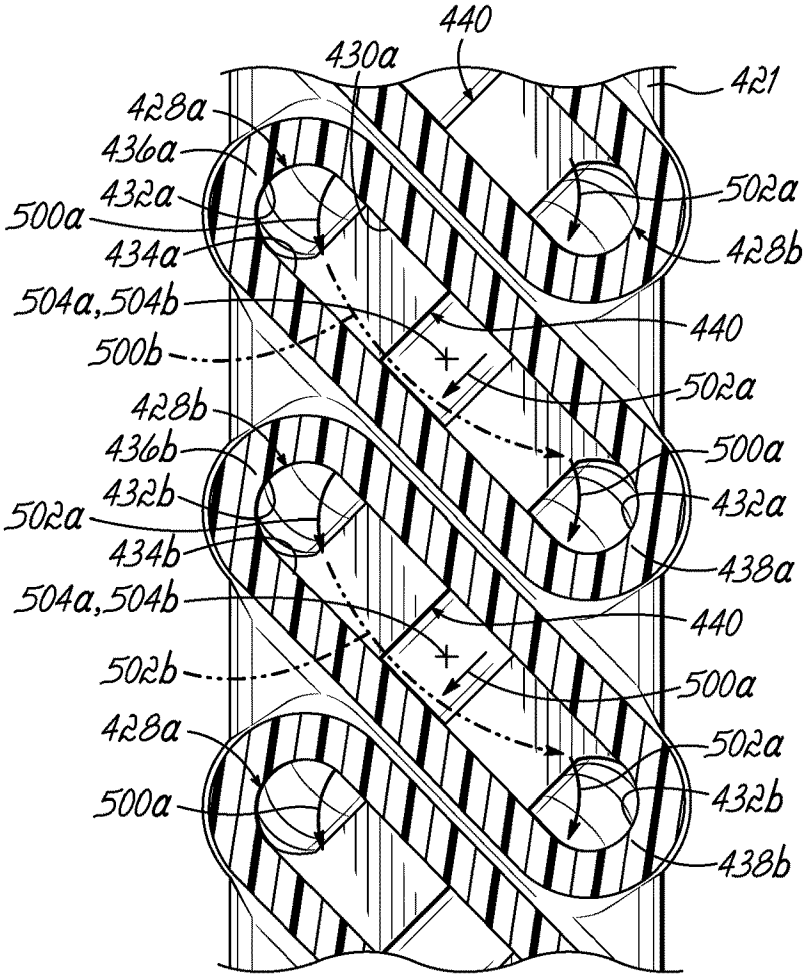
FIG. 11A is a cross-sectional view of the static mixer of FIG. 10, taken along line 11A-11A shown in FIG. 10D.
Figure 11D:
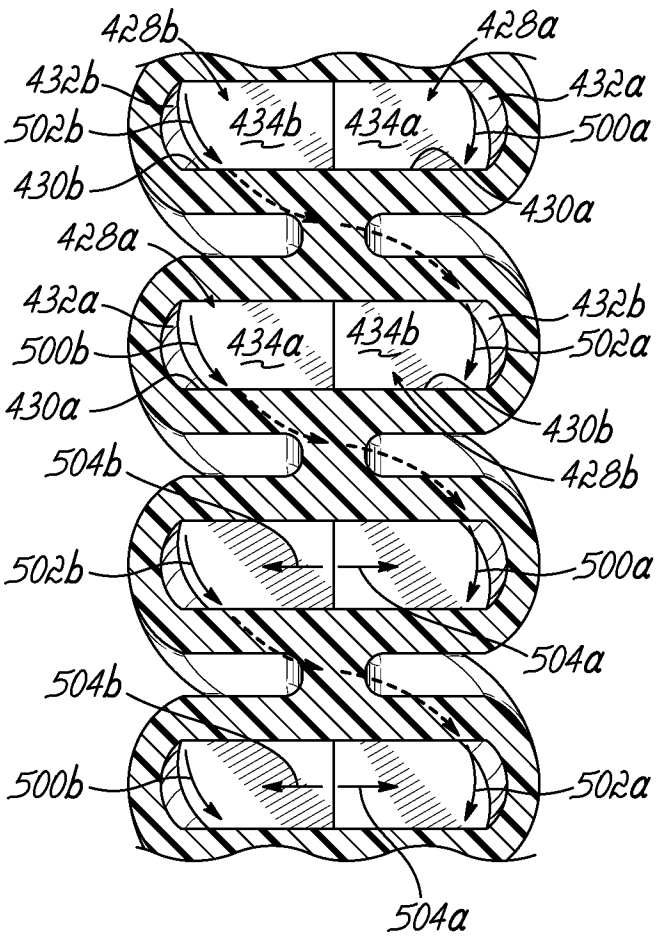
FIG. 11D is a cross-sectional view of the static mixer of FIG. 10, taken along line 11D-11D shown in FIG. 10D
Figure 11C:
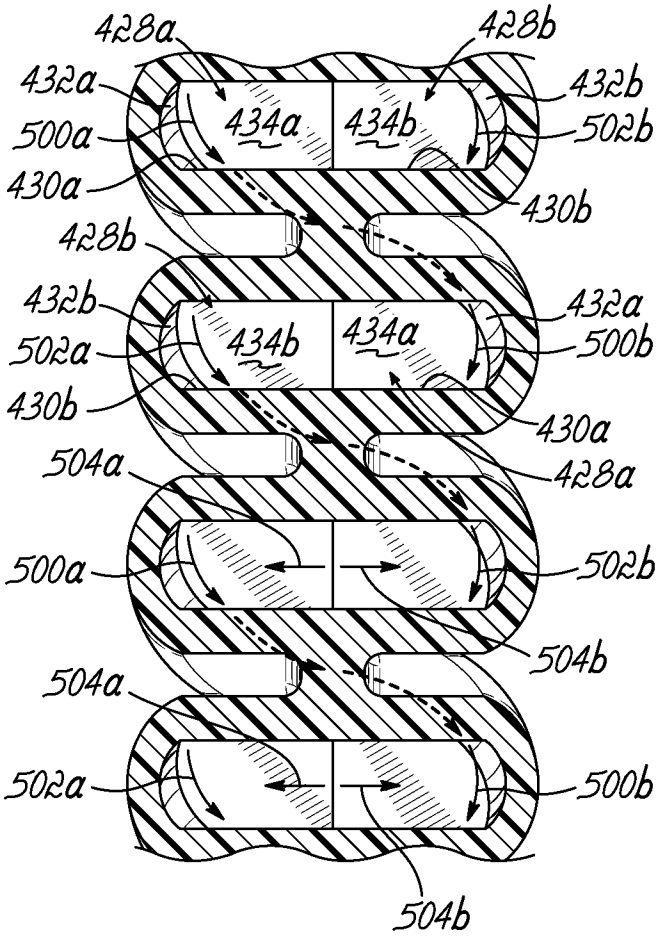
FIG. 11C is a cross-sectional view of the static mixer of FIG. 10, taken along line 11C-11C shown in FIG. 10D.

The second flow path portion 134 begins 180 degrees offset from the first flow path portion 132. Where the two flow path portions 132, 134 meet (i.e., where the first flow path portion 132 ends and the second flow path portion 134 begins, or vice versa), the flow path includes a generally square shape 141 in cross section (FIGS. 15A, 15E, 17A, 17E). The first and second flow path portions 132, 134 generally repeat to form the mixing portion 114. Of course, the mixing portion 114 may include only portions of the first flow path portion 132 and/or the second flow path portion 134, such as where the inlet portion 112 ends and the mixing portion 114 begins, or where the mixing portion 114 ends and the outlet portion 116 begins. In one embodiment, as best shown in FIG. 4B, the shape 133 defined by the outer wall 123, taken in cross section along a plane (not shown) that is perpendicular to the central axis 126, is substantially similar to the shape 136 defined by at least a portion of the flow path taken along the same cross section.

Referring to FIGS. 4A and 5A-5D, the first and second flow path portions 132, 134 of the single flow path include certain features that cause different portions of a mass fluid flow to be diverted in different directions within the single flow path. The first flow path portion 132 includes an opposing pair of first and second helical ridges 144, 146 and an opposing pair of first and second helical faces 148, 150. Each of the faces 148, 150 is positioned between a pair of helical ridges 144, 146. Each helical face 148, 150 traverses a helical pattern for approximately 180 degrees about the axis 126. As shown, the first helical face 148 is positioned between the distal portion 152 of the second ridge 146 and the proximal portion 154 of the first ridge 144. The second helical face 150 is positioned between the proximal portion 156 of the second ridge 146 and the distal portion 158 of the first ridge 144. Each of the helical faces 148, 150 includes at least a portion that is planar in cross section. A plane (not shown) positioned tangent to the each of the faces 148, 150, respectively, would be parallel to the axis 126. The first flow path portion 132 also includes a distal pair of opposing planar faces 160, 162 that are situated transversely (perpendicularly as shown) to the axis 126. Planar faces 160, 162 are center-to-perimeter portions that are configured to direct fluid flow radially away from the axis 126. The first flow path portion 132 also includes a more proximal planar face 164 that is a perimeter-to center portion that is configured to direct fluid flow radially towards the axis 126.

The proximal portions 154, 156 of each ridge 144, 146, respectively, define a plurality of perimeter-to-center portions that are operative to direct the fluid flow radially inward towards the axis 126. Similarly, the distal portions 152, 158 of each ridge 146, 144 define a plurality of center-to-perimeter portions that are operative to direct the mass fluid flow radially away from the axis 126. The first ridge 144 is separated into the proximal and distal portions 154, 158 by an imaginary helical mid-line 166. Similarly, the second ridge 146 is separated into the proximal and distal portions 156, 152 by another imaginary helical mid-line 168. The ridges 144, 146 and faces 148, 150 define first and second grooves 169*a*, 169*b*. More particularly, the first groove 169*a* is defined by the first face 148, the distal portion 152 of the second ridge 146, and the proximal portion 154 of the first ridge 144. The second groove 169*b* is defined by the second face 150, the proximal portion 156 of the second ridge 146 and the distal portion 158 of the first ridge 144.

The second portion 134 is structurally similar to the first portion 132, and offset from the first portion 132 by 180 degrees. In that regard, the second portion 134 includes third and fourth opposing helical ridges 170, 172 (A, x) and third and fourth helical faces 174, 176 (z, y). Each of the faces 174, 176 is positioned between a pair of helical ridges 170, 172. Each helical face 174, 176 traverses a helical pattern for approximately 180 degrees about the central axis 126. Each of the faces 174, 176 includes at least a portion that is planar in cross section. A plane (not shown) positioned tangent to the each of the faces 174, 176, respectively, points in a direction that is parallel to the axis 126. The second flow path portion 134 also includes more proximal, planar center-to-perimeter faces 178 and more distal, planar perimeter-to-center faces 180, 182. Each of the faces 178, 180, 182 is planar and positioned perpendicular to central axis 126.

Thus, while a mass fluid flow directed into the conduit 124 flows along the single flow path having the shape 136 described generally above, the features created by the undercuts cause different portions of the mass fluid flow to flow in different directions within the single flow path, thus mixing the mass fluid flow.

In that regard, a mass fluid flow flows in the distal direction (flow direction) into the first flow path portion 132. There, a portion of the mass fluid flow flows co-axially along lumen portion 130 (arrow 184) and helically along faces 148, 150 and within grooves (arrows 186). Moreover, a portion of the mass fluid flow flows radially outward along the center-to perimeter faces 160, 162 (arrows 188, 190), radially inward along the distal, perimeter-to-center portions of ridges 144, 146 (arrows 192, 194), radially outward along the center-to-perimeter portions of ridges 144, 146 (arrows 196, 198), and radially inward along face 164 (arrow 200). These portions of flow flowing in different directions within the single flow path interact and cause mixing of the mass fluid flow.

The mass fluid flow flows into the second flow path portion 134, whereby it is mixed further. After exiting the first flow path portion 132, the mass fluid flow flows along faces 174, 176 (arrows 202) and within grooves 169*c*, 169*d*. A portion of the mass fluid flow flows radially inward along the perimeter-to-center portions of the helical ridges 172, 170 (arrows 204, 206) and radially outward along the center-to-perimeter portions of ridges 172, 170 (arrows 208, 210). A portion of the mass fluid flow flows radially inward along faces 180, 182 (arrows 212, 214) and radially outward along face 178 (arrow 216). As before, these portions of mass fluid flow flowing in different direction in the single flow path interact, thus further mixing the mass fluid flow. The first and second flow path portions 132, 134 repeat along the conduit 124 a length sufficient to mix the mass fluid flow. Once sufficiently mixed, the at least one fluid may be dispensed from the outlet portion 116.

Referring to FIGS. 6 through 7D and FIGS. 18 through 21E an alternative embodiment of a static mixer 310 is shown. The static mixer 310 is a single unitary body and includes an inlet portion 312, a mixing portion 314, and an outlet portion 316. As shown, the static mixer 310 includes an open proximal end 318, an open distal end 320, and an inner wall 322 defining a conduit 324 extending along a central axis 326. The static mixer 310 also includes an outer wall 323. The inlet portion 312 includes a plurality of threads 328 to allow the static mixer 310 to be coupled to a source of at least one fluid. The inner wall 322, along at least a portion of the mixing portion 314, includes a plurality of integrally formed convolutions defined by a plurality of undercuts (convolutions and undercuts described in more detail below). As shown, none of the undercuts intersects the axis and therefore a lumen portion 330 of the conduit extends continuously along and coaxially relative to the central axis 326 along the entire length of the mixing portion 314. The undercuts include a depth $d_3$ that prevents the static mixer 310 as shown to be made by an injection molding process. Moreover, the generally tubular configuration of the static mixer 310 prevents any side pull that may enable any injection molding process to be used to manufacture the static mixer 310.

As shown, the undercuts define a single flow path including a first flow path portion 332 and a second flow path portion 334 that repeat along the length of the mixing portion. More particularly, referring specifically to FIGS. 18 through 19E, the first flow path portion 332 has a shape that is formed by rotating a generally rectangular shape 336 (in cross section) about an axis in a first rotational direction (arrows 338) (clockwise as shown) 180 degrees, while translating the generally rectangular shape 336 along the axis 326 in a flow direction. The second flow path portion 334 includes a substantially similar shape as the first flow path portion 332 and is formed by rotating a generally rectangular shape 336 about the axis 326 in a second rotational direction (arrows 340) (counterclockwise as shown) 180 degrees while translating the generally rectangular shape 336 along the axis 326. Thus, the flow path, in cross section, taken along a plane (not shown) that is perpendicular to the axis 326, is generally rectangular in shape and includes a pair of straight opposing edges 342 and a pair of curved opposing edges 344 therebetween. The second flow path portion 334 begins where the first flow path portion ends (i.e., lines 19E-19E (FIG. 18) and 21A-21A (FIG. 20) are the same lines) and is thus a continuation of the first flow path portion 332, with the generally rectangular shape 336 being rotated in the opposite direction and translated along the axis 326 in the flow direction.

The first and second flow path portions 332, 334 of the single flow path include certain features that cause different portions of a mass fluid flow to be diverted in different directions within the single flow path. The first flow path portion 332 includes an opposing pair of first and second helical ridges 346, 348 and an opposing pair of first and second helical faces 350, 352. Each of the faces 350, 352 is positioned between a pair of helical ridges 346, 348. As shown, the first helical face 350 is positioned between a proximal portion 354 of the first ridge 346 and the distal portion 356 of the second ridge 348. The second helical face 352 is positioned between the distal portion 358 of the first ridge 346 and the proximal portion 360 of the second ridge 348. Each of the helical faces 350, 352 includes at least a portion that is planar in cross section. A plane (not shown) positioned tangent to the each of the faces 350, 352, respectively, would be parallel to the axis 326. Each of the ridges 346, 348 defines a perimeter-to-center portion that is operative to direct the fluid flow radially towards the axis 326 and a center-to-perimeter portion that directs the flow radially away from the axis 326. The perimeter-to-center portion of each ridge 346, 348 begins at the proximal portion 354, 360, respectively and ends at an imaginary helical mid-line 363, 365. The center-to-perimeter portion of each ridge 346, 348 begins at the imaginary mid-lines 363, 365, and extends to the distal portion 358, 356 of each ridge 346, 348, respectively.

The second flow path portion 334 includes an opposing pair of third and fourth helical ridges 362, 364 and an opposing pair of third and fourth helical faces 366, 368 (B, D). Each of the faces 366, 368 is positioned between a pair of helical ridges 362, 364. As shown, the third helical face 366 is positioned between the distal portion 370 of the third ridge 362 and the proximal portion 372 of the fourth ridge 364. The fourth helical face 368 is positioned between the proximal portion 374 of the third ridge 362 and the distal portion 376 of the fourth ridge 364. Each of the helical faces 366, 368 includes at least a portion that is planar in cross section. A plane (not shown) positioned tangent to the each of the faces 366, 368 respectively, would be parallel to the axis 326. Where the first and second flow path portions 332, 334 meet, helical face 350 meets helical face 366 and helical face 352 meets helical face 368.

Each ridge 362, 364 of the second flow path portion 334 defines a perimeter-to-center portion that is operative to direct the fluid flow radially towards the axis 326 and a center-to-perimeter portion that directs the flow radially away from the axis 326. The perimeter-to-center portion of each ridge 362, 364 begins at each proximal portion 374, 372, respectively and ends at an imaginary helical mid-line 378, 380. The center-to-perimeter portion of each ridge 362, 364 begins at the imaginary mid-line 378, 380 and extends to the distal portion 370, 376 of each ridge 362, 364, respectively.

As a mass fluid flow is directed into the conduit, the mass fluid flow flows into the mixing portion 314 in the distal direction (flow direction) and enters a first flow path portion 332. Portions of a mass fluid flow are represented by arrows, described below. There, a portion of the mass fluid flow flows co-axially along lumen portion 330 (arrows 382) and helically along faces 350, 352 (arrows 384). A portion of the mass fluid flow flows radially inward along the perimeter-to-center portions of ridges 346, 348 (arrows 386) and radially outward along the center-to-perimeter portions of ridges 346, 348 (arrows 388). These portions of flow flowing in different directions within the single flow path interact and cause mixing of the mass fluid flow.

The mass fluid flow then flows into second flow path portion 334, whereby it is mixed further. After exiting the first flow path portion 332, the mass fluid flow continues to flow axially along lumen portion 330 (arrow 382), and helically along faces 366, 368 (arrows 390). A portion of the mass fluid flow flows radially inward along the perimeter-to-center portions of the helical ridges 362, 364 (arrows 392) and radially outward along the center-to-perimeter portions of ridges 362, 364 (arrows 394). As before, these portions of mass fluid flow flowing in different direction in the single flow path interact, thus further mixing the mass fluid flow. The first and second flow path portions 332, 334 repeat along the conduit a length sufficient to mix the mass fluid flow. Of course, the mixing portion 314 may include only portions of either the first and second flow path portions 332, 334, for example, where the inlet portion 312 ends and the mixing portion 314 begins, or where the mixing portion 314 ends and the outlet portion 316 begins. Once sufficiently mixed, the at least one fluid may be dispensed from the outlet portion 316.

FIGS. 10 through 11D and 27A through 27E show an alternative embodiment of a static mixer 410. The static mixer 410 is a single unitary body and includes an inlet portion 412, a mixing portion 414, and an outlet portion 416. As shown, the static mixer 410 includes an open proximal end 418, an open distal end 420. The static mixer 410 includes an inner wall 422 extending between the proximal and distal ends 418, 420 and defining first and second conduits 424*a*, 424*b*, at least along the length of the mixing portion 414. The static mixer 410 also includes an outer wall 421 extending between the proximal and distal ends 418, 420. The first and second conduits 424*a*, 424*b* extend generally along a central axis 426. The single, unitary body static mixer 410 may be manufactured by a compression blow molding process.

Each of the first and second conduits 424*a*, 424*b* is configured to mix a mass fluid flow. In that regard, each of the first and second conduits 424*a*, 424*b* is generally convoluted and defined by a plurality of cavities 428*a*, 428*b* formed by the inner wall 422. For simplicity, cavities defining the first conduit 424*a* are labeled 428*a*, while cavities defining the second conduit 424*b* are labeled with reference numerals 428*b*. Moreover, each conduit 424*a*, 424*b* may include only portions of cavities 428*a*, 428*b*, for example, at the beginning and end of the mixing portion 414. Each cavity 428*a*, 428*b* includes a generally arcuate or disc shape and is more particularly defined by a pair of planar faces 430*a*, 430*b*, a curved edge 432*a*, 432*b* opposing the planar faces 430*a*, 430*b*, and a pair of opposing, generally arcuate planar faces 434*a*, 434*b* therebetween, respectively. Cavities 428*a* connect with one another to form the first conduit 424*a*, while cavities 428*b* connect with one another to form conduit 424*b*. Each cavity 428*a* includes a first, upstream end 436*a* and a second, downstream end 438*a*. Similarly, each cavity 428*b* includes a first, upstream end 436*b* and a second, downstream end 438*b*. As shown, contiguous cavities 428*a* connect with one another such that a first, upstream end 436*a* connects with the second, downstream end 438*a* of an upstream cavity 428*a*. Similarly, contiguous cavities 428*b* connect with one another such that a first, upstream end 436*b* connects with the second, downstream end 438*b* of an upstream cavity 428*b*. Each cavity 428*a*, 428*b* of a respective conduit 424*a*, 424*b* is positioned 90 degrees relative to a contiguous cavity 428*a*, 428*b* in the same conduit 424*a*, 424*b*. In that regard, as shown best in FIGS. 11A-11B, the arcuate planar faces 434*a*, 434*b* of a downstream cavity extend ninety degrees relative to the arcuate planar faces 434*a*, 434*b* of a contiguous upstream cavity, respectively.

The first and second conduits 424*a*, 424*b* are fluidly connected by a plurality of third conduits 440 at certain points along the axis 426. Each of the third conduits 440 is more particularly an aperture defined as being between the planar faces 430*a*, and planar faces 434*a* of adjacent, opposing cavities 428*a*, 428*b* from a different conduit. As shown, each third conduit 440 extends between the first and second conduits 424*a*, 424*b* in a direction that is generally transverse (perpendicular as shown) to the central axis 426. Therefore, while the first and second conduits 424*a*, 424*b* are generally offset from one another by approximately 90 degrees about the axis 426, the plurality of third conduits 440 fluidly connect the first and second conduits 424*a*, 424*b* at several points along the axis 426.

Therefore, as a mass fluid flow flows into the mixing portion 414, portions of the mass fluid flow are initially forced into each of the first and second conduits 424*a*, 424*b*. Due to the shape of the first and second conduits 424*a*, 424*b*, a mass fluid flow flows in a generally helical path within each of the conduits 424*a*, 424*b*. As a mass fluid flow flows into a cavity 428*a*, 428*b*, it may flow in several directions within the cavity 428*a*, 428*b*. For example, some may flow in a curved path along the curved edges 432*a*, 432*b*, axially along the planar faces 430*a*, 430*b*, or axially along the arcuate planar faces 434*a*, 434*b*, for example. Arrows 500*a*, 500*b*, 502*a*, 502*b*, 504*a*, and 504*b* are exemplary portions of flow paths that a portion of a mass fluid flow may traverse as it flows through the mixing portion 414. In that regard, at least a portion of a mass fluid flowing in the first conduit 424*a* may traverse a path as shown by arrows 500*a*, 500*b*. As shown, the flow path portions represented by arrows 500*a*, 500*b* each traverse a generally arcuate path within the first conduit 424*a*. As shown, the flow path portion represented by arrow 500*a* is positioned ninety degrees relative to the flow path portion represented by arrow 500*b* due to the configuration of cavities 428*a* of first conduit 424*a*, as described above. Similarly, fluid flowing in the second conduit 424*b* may traverse a path as generally shown by arrows 502*a*, 502*b*. As shown, the flow path portion represented by arrow 502*a* is positioned ninety degrees relative to the flow path portion represented by arrow 502*b* due to the configuration of cavities 428*b* of second conduit 424*b*, as described above. As described hereinabove, portions of a mass fluid flow may flow between the first and second conduits 424*a*, 424*b* through the third conduits 440, as represented by the arrows 504*a*, 504*b*. Arrow 504*a* represents a flow path of a portion of mass fluid flow flowing from the second conduit 424*b* into the first conduit 424*a* via one of the third conduits 440 (in a direction generally transverse and/or perpendicular to the axis 426). Similarly, arrow 504*b* represents a flow path of a portion of mass fluid flow flowing from the first conduit 424*a* into the second conduit 424*b*, via one of the third conduits 440 (in a direction generally transverse and/or perpendicular to the axis 426).

Figure 28:
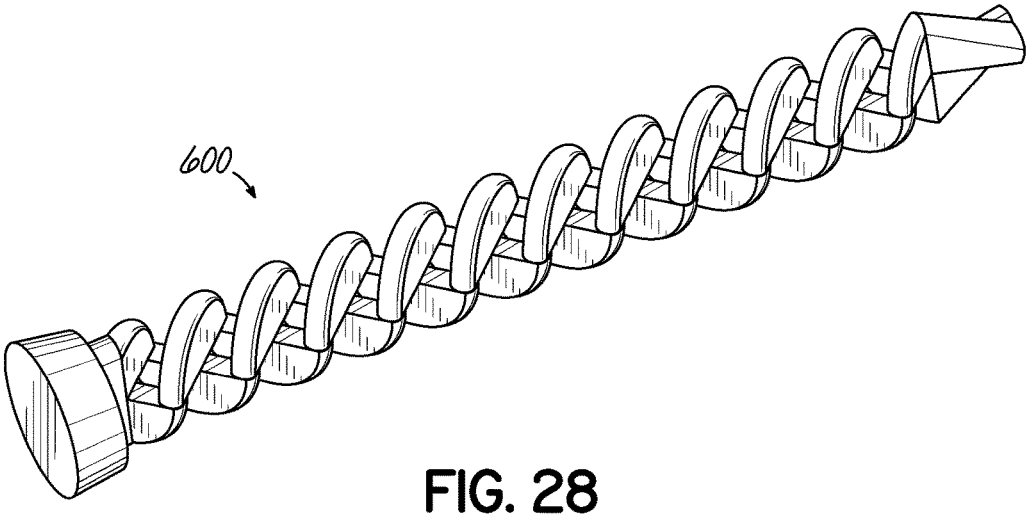
FIG. 28 shows a perspective view of an exemplary flow path associated with the static mixer of FIG. 10.
Figure 29:
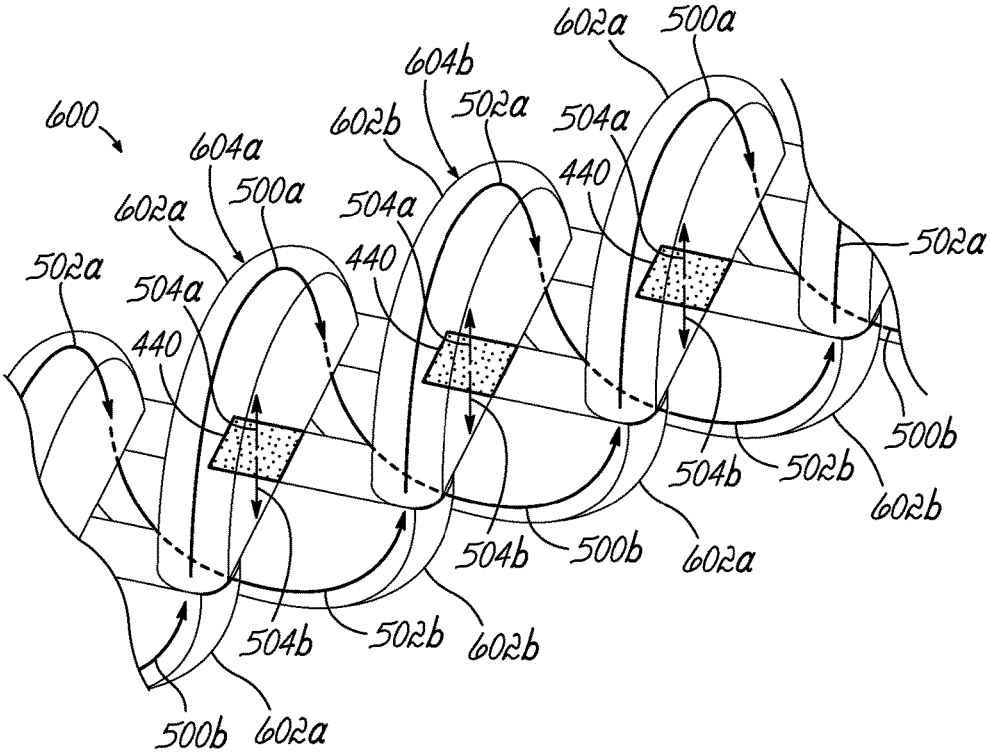
FIG. 29 is detailed view of the exemplary flow path shown in FIG. 28.

Thus, a mass fluid flow may be mixed while flowing along the convoluted first and second conduits 424*a*, 424*b* and is further mixed when flowing between the first and second conduits 424*a*, 424*b* via the third conduits 440. For simplicity, an exemplary flow path of a mass fluid flow 600 flowing through the mixing portion 414 of the static mixer 410 is shown in FIGS. 28 and 29. As shown, portions 602*a*, 602*b* of the mass fluid flow 600 are generally shaped similarly as the cavities 428*a*, 428*b* defining the first and second conduits 424*a*, 424*b*. In that regard, the mass fluid flow 600 includes a plurality of arcuate or disc-shaped portions 602*a*, 602*b* that represent a first flow path 604*a* (associated with the first conduit 424*a*) and a second flow path 604*b* (associated with the second conduit 424*b*), respectively. Each contiguous disc-shaped portion 602*a*, 602*b* of a respective flow path portion 604*a*, 604*b* is oriented generally ninety degrees relative to a contiguous (upstream or downstream) disc-shaped portion 602*a*, 602*b*. As shown, the first flow path portion 604*a* and second flow path portion 604*b* intersect (at third conduits 440) to allow fluid to flow between the first and second flow path portions 604*a*, 604*b* to be further mixed. The flow path portions represented by arrows 500*a*, 500*b*, 502*a*, 502*b*, 504*a*, and 504*b*, as described above, are shown within the mass fluid flow 600 for the same exemplary purposes as described above. Once sufficiently mixed, the at least one fluid may be dispensed from the outlet portion 416.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A static mixer for mixing a flow of at least one fluid, the static mixer comprising:

an elongate body having an open proximal end, an open distal end, and an inner wall, at least a portion of the inner wall having a groove and a plurality of undercuts formed therein to define at least one convoluted conduit, the conduit extending along a central axis between the proximal end and the distal end, wherein a portion of the undercuts defines a center-to-perimeter flow portion within the conduit, and a portion of the undercuts defines a perimeter-to-center flow portion within the conduit, wherein the groove is defined at least in part by a first undercut and a second undercut of the plurality of undercuts, the first undercut and the second undercut being opposite one another in the inner wall.

2. The static mixer of claim 1, wherein a portion of the conduit extends coaxially relative to and continuously along the central axis between the proximal end and the distal end.

3. The static mixer of claim 1, wherein a portion of the undercuts defines a helical portion traversing about the central axis.

4. The static mixer of claim 3, wherein the helical portion includes a groove, the groove having a face facing in a direction perpendicular to the central axis.

5. The static mixer of claim 1, wherein none of the undercuts intersects the central axis.

6. The static mixer of claim 1, wherein at least one of the undercuts defines a face positioned transversely to the central axis.

7. The static mixer of claim 6, wherein the face is positioned perpendicularly to the central axis.

8. The static mixer of claim 6, wherein the face faces a direction towards the proximal end.

9. The static mixer of claim 6, wherein the face faces a direction towards the distal end.

10. The static mixer of claim 1, further comprising:

an inlet portion at the proximal end, the inlet portion including threads for coupling to a source of the at least one fluid.

11. The static mixer of claim 1, wherein a cross-section of the at least a portion of the inner wall, taken along a plane transverse to the central axis, comprises exactly two grooves.

12. A static mixer for mixing a flow of at least one fluid, the static mixer comprising:

an elongate body extending along a central axis and including an open proximal end, an open distal end, and an inner wall, the inner wall including a groove and a plurality of undercuts formed integrally therein to define a single flow path, wherein the groove is defined, at least in part, by a first undercut of the plurality of undercuts and a second undercut of the plurality of undercuts, wherein the first undercut is defined by a first ridge of the inner wall, a proximate portion of the first ridge positioned adjacent a first face of the inner wall and a distal portion of the first ridge positioned adjacent a second face of the inner wall, wherein the second undercut is defined by a second ridge of the inner wall, a proximate portion of the second ridge positioned adjacent the second face of the inner wall and a distal portion of the second ridge positioned adjacent the first face of the inner wall, wherein at least a portion of the flow path extends coaxially along the central axis, at least a portion of the flow path extends radially away from the central axis, and at least a portion of the flow path extends radially towards the central axis, and wherein the first undercut and the second undercut are opposite one another in the inner wall.

13. The static mixer of claim 12, wherein at least a portion of the flow path extends circumferentially about the central axis.

14. The static mixer of claim 12, wherein at least a portion of the flow path extends helically about the central axis.

15. The static mixer of claim 14, wherein a first portion of the helical portion of the flow path at least partially circumscribes the central axis in a first direction, and a second portion of the helical portion of the flow path at least partially circumscribes the central axis in a second, opposite direction.

16. The static mixer of claim 12, wherein at least a portion of the flow path extends transversely relative to the central axis.

17. The static mixer of claim 12, wherein at least a portion of the flow path extends perpendicularly relative to the central axis.

18. The static mixer of claim 12, at least a portion the flow path extends coaxially and continuously along the central axis from the proximal end to the distal end.

19. A static mixer for mixing a flow of at least first and second fluids, the static mixer comprising:

an elongate member having an open proximal end defining an inlet portion, an open distal end defining an outlet portion, and a mixing portion between the inlet portion and outlet portion, the mixing portion including a first convoluted conduit extending along a central axis from the inlet portion towards the distal end, and a second convoluted conduit extending along the central axis from the inlet portion towards the distal end, the first and second conduits being fluidly connected by at least one third conduit extending between the first and second conduits in a direction transverse to the central axis.

20. The static mixer of claim 19, wherein at least one of the first or second conduits defines a flow path that traverses an at least partially helical path about the central axis.

21. The static mixer of claim 19, wherein the at least one third conduit is defined by an aperture positioned between the first conduit and second conduit.

22. The static mixer of claim 19, wherein the elongate member is a single, unitary body.

23. The static mixer of claim 19, wherein at least one of the first or second conduits is at least partially defined by a plurality of cavities fluidly connected to one another.

24. The static mixer of claim 23, wherein a portion of the plurality of cavities includes a first, upstream end and a second, downstream end, wherein contiguous cavities connect to one another such that the first end of a downstream cavity connects to the second end of an upstream cavity.

25. The static mixer of claim 19, wherein at least a portion of one of the first or second conduits has a cross-sectional shape of a segment of a circle, the cross-section taken along a plane that is transverse to the central axis.

* * * * *